US008173582B2

(12) United States Patent
Suda et al.

(10) Patent No.: US 8,173,582 B2
(45) Date of Patent: May 8, 2012

(54) OIL COMPOSITION FOR USE IN TRACE OIL SUPPLY CUTTING/GRINDING WORK

(75) Inventors: Satoshi Suda, Yokohama (JP); Hideo Yokota, Yokohama (JP); Tomoyasu Kochu, Toyota (JP); Yoshiaki Matsuura, Toyota (JP)

(73) Assignee: Nippon Oil Corporation, Tokyo (JP)

( * ) Notice: Subject to any disclaimer, the term of this patent is extended or adjusted under 35 U.S.C. 154(b) by 0 days.

(21) Appl. No.: 11/666,829

(22) PCT Filed: Nov. 1, 2005

(86) PCT No.: PCT/JP2005/020142

§ 371 (c)(1),
(2), (4) Date: Jul. 2, 2008

(87) PCT Pub. No.: WO2006/049187

PCT Pub. Date: May 11, 2006

(65) Prior Publication Data

US 2008/0318820 A1 Dec. 25, 2008

(30) Foreign Application Priority Data

Nov. 1, 2004 (JP) ..... P2004-318251

(51) Int. Cl.
*C10M 105/34* (2006.01)
*C10M 145/14* (2006.01)
*C07C 69/34* (2006.01)

(52) U.S. Cl. ..... 508/463; 508/465; 508/469

(58) Field of Classification Search ..... 508/465
See application file for complete search history.

(56) References Cited

U.S. PATENT DOCUMENTS

| | | | | |
|---|---|---|---|---|
| 3,510,425 | A | 5/1970 | Wilson | |
| 5,726,130 | A * | 3/1998 | Yamanaka | 508/152 |
| 5,750,750 | A * | 5/1998 | Duncan et al. | 554/117 |
| 6,858,569 | B2 * | 2/2005 | Yokota et al. | 508/485 |
| 2002/0035043 | A1 * | 3/2002 | Yokota et al. | 508/485 |
| 2004/0092409 | A1 * | 5/2004 | Liesen | 508/469 |
| 2004/0116308 | A1 | 6/2004 | Yokota et al. | |
| 2004/0116309 | A1 | 6/2004 | Yokota et al. | |
| 2004/0248744 | A1 * | 12/2004 | King et al. | 508/437 |

FOREIGN PATENT DOCUMENTS

EP 0 612 832 8/1994

(Continued)

OTHER PUBLICATIONS

Supplemental European Search Report dated Jan. 23, 2009.

*Primary Examiner* — Walter D Griffin
*Assistant Examiner* — Vishal Vasisth
(74) *Attorney, Agent, or Firm* — Finnegan, Henderson, Farabow, Garrett & Dunner, LLP

(57) ABSTRACT

This invention provides an oil composition for cutting and grinding by minimum quantity lubrication system, characterized by comprising an ester oil with a kinematic viscosity of 0.5-20 $mm^2/s$ at 100° C., and an ester-based polymer with a kinematic viscosity exceeding 20 $mm^2/s$ at 100° C. and an average molecular weight of 5,000-10,000,000. The oil composition for cutting and grinding by minimum quantity lubrication system according to the invention can achieve an excellent balance between misting property and inhibition of floating mist and ensure that an adequate amount reaches the working section, for cutting and grinding by minimum quantity lubrication system.

1 Claim, 2 Drawing Sheets

FOREIGN PATENT DOCUMENTS

| | | | |
|---|---|---|---|
| JP | 49-4041 | | 1/1974 |
| JP | 8-41481 | | 2/1996 |
| JP | 9-132791 | | 5/1997 |
| WO | WO 98/10040 | | 3/1998 |
| WO | WO 01/30945 | A1 | 5/2001 |
| WO | WO 02/081605 | A1 | 10/2002 |
| WO | WO 02/083823 | A1 | 10/2002 |
| WO | WO 03/080771 | | 10/2003 |

* cited by examiner

OIL COMPOSITION FOR USE IN TRACE OIL SUPPLY CUTTING/GRINDING WORK

CROSS-REFERENCE TO RELATED APPLICATIONS

This application is a national phase application of International Application No. PCT/JP2005/020142, filed Nov. 1, 2005, and claims the priority of Japanese Application No. 2004-318251, filed Nov. 1, 2004, the content of both of which is incorporated herein by reference.

TECHNICAL FIELD

The present invention relates to an oil composition for cutting and grinding by minimum quantity lubrication (MQL) system, and more specifically it relates to an oil composition for cutting and grinding of a workpiece while supplying a minimum quantity of oil to a working section together with a compressed fluid.

BACKGROUND ART

In cutting and grinding, it is common to employ cutting and grinding oils for the purpose of extending the life of working tools such as drills, end mills, cutting tools, grinding wheels and the like, improving the surface roughness of working surfaces and raising productivity in mechanical working by increasing machining performance.

Cutting and grinding oils fall into two general categories, namely water-soluble cutting and grinding oils used by diluting surfactants and lubricant components with water, and non-water-soluble cutting and grinding oils used directly as stock solutions composed mainly of mineral oils. In conventional cutting and grinding, a relatively large amount of cutting and grinding oil is supplied to the working section regardless of the type of oil.

The most basic and important functions of a cutting and grinding oil are the lubricating function and cooling function. Generally speaking, non-water-soluble cutting and grinding oils exhibit superior lubricating performance while water-soluble cutting and grinding oils exhibit superior cooling performance. Because the cooling effect of non-water-soluble oils is inferior to that of water-soluble oils, there is usually required a large amount of non-water-soluble cutting and grinding oil, from several liters to in some cases several tens of liters per minute.

Cutting and grinding oils that are effective for improving machining performance have drawbacks from other viewpoints, typically their adverse effects on the environment. Whether non-water-soluble or water-soluble, oils undergo gradual degradation with use and eventually become unusable. In the case of water-soluble oils, for example, solution stability is lost with growth of microorganisms, resulting in separation of the components, significant fouling of the environment and unsuitability for use. In the case of non-water-soluble oils, progressive oxidation produces acidic components that corrode metal materials and produce significant changes in viscosity, also resulting in unsuitability for use. The oils also adhere to shaved chips and the like, becoming consumed and forming waste.

The degraded oils must therefore be disposed of and replaced with new oils. Oils that have been discharged as waste must be treated in some manner to avoid adversely affecting the environment. For example, chlorine-based compounds that can potentially generate harmful dioxin during thermal disposal are often used in cutting and grinding oils developed for the principal purpose of improving working efficiency, and such compounds must therefore be removed. Cutting and grinding oils containing no chlorine-based compounds have therefore been developed, but even cutting and grinding oils free of such harmful components affect the environment if their waste disposal volume is large. Water-soluble oils can also contaminate environmental waters and therefore require costly high-level treatment.

Research has been conducted recently with cooling of cutting and grinding areas by cool air blowing, instead of using cutting and grinding oils, as a means of dealing with these problems, but the lubricating performance provided by cutting and grinding oils cannot be achieved.

In light of this background, a cutting and grinding process in minimum quantity lubrication system has been developed in which a trace amount of oil at about 1/100,000-1/1,000,000 of the amount of oil used for conventional cutting and grinding is supplied to the working section together with a compressed fluid (for example, compressed air) for cutting and grinding. In such systems, a cooling effect is achieved due to the compressed air, and the trace amount of oil used allows the amount of waste to be reduced, thereby resulting in improvement in the effect on the environment that is caused by large-scale emission of waste products (for example, see Patent documents 1, 2).

[Patent document 1] WO02/083823

[Patent document 2] WO02/081605

DISCLOSURE OF THE INVENTION

Problems to be Solved by the Invention

The oil used in the aforementioned minimum quantity lubrication system cutting and grinding process must have the property of easily misting (hereinafter referred to as "misting property"), because of the manner in which it is used. Using an oil with a low misting property results in insufficient oil reaching the working section, making it impossible to ensure adequate machining performance.

However, investigation by the present inventors has shown that simply using an oil with a high misting property produces a mist that floats in the atmosphere as it forms and does not reach the working section, or a mist that reaches the working section but flies away without remaining on the working section (hereinafter, this will be referred to as "floating mist"). This also reduces the effective amount of oil functioning at the working section, making it impossible to ensure adequate machining performance. Moreover, generation of a floating mist is also undesirable from the viewpoint of the working environment.

It is an object of the present invention, which has been accomplished in light of the circumstances described above, to provide an oil that can achieve an excellent balance between the misting property and inhibition of floating mist when performing cutting and grinding with minimum quantity lubrication system, thereby ensuring that a sufficient amount reaches the working section.

Means for Solving the Problems

In order to solve the problems described above, the oil composition for cutting and grinding by minimum quantity lubrication system according to the invention is characterized by comprising an ester oil with a kinematic viscosity of 0.5-20 $mm^2/s$ at 100° C., and an ester-based polymer with a kinematic viscosity exceeding 20 $mm^2/s$ at 100° C. and an average molecular weight of 5,000-10,000,000.

Ester-based polymers with a kinematic viscosity exceeding 20 $mm^2/s$ at 100° C. include those with a measured kinematic viscosity of greater than at 100° C., as well as those whose kinematic viscosity at 100° C. is too high to be measured (semi-solids, solids and the like).

The oil composition for cutting and grinding by minimum quantity lubrication system according to the invention (hereinafter also referred to simply as "oil composition of the invention") employs both an ester oil with a kinematic viscosity at 100° C. which satisfies the aforementioned conditions, and an ester-based polymer whose kinematic viscosity at 100° C. and average molecular weight satisfy the aforementioned conditions, thereby allowing an excellent balance to be achieved between the misting property and inhibition of floating mist, in order to ensure that an adequate amount reaches the working section. Moreover, upon reaching the working section, the oil composition of the invention can adequately enhance the machining performance for cutting and grinding with the minimum quantity lubrication system.

Although the reason for this effect of the invention is not fully understood, the present inventors conjecture as follows. That is, it is believed that the high affinity of the ester-based polymer of the invention for the ester oil provides a function of stably maintaining the ester oil in the oil composition of the invention. Thus, while ester oils when used alone exhibit a very high misting property but form minute oil droplets that can result in floating mist, these are captured by the ester-based polymer and prevented from forming a floating mist. On the other hand, ester oil droplets of a size that can separate from the ester-based polymer, as well as oil droplets composed of the ester oil and ester-based polymer, have a high misting property and are resistant to size increase by reaggregation, thus being able to reliably reach the working section. The present inventors conjecture that the ester oil droplet size-adjusting function of the ester-based polymer is responsible for achieving both a misting property and inhibition of floating mist.

Effect of the Invention

The cutting and grinding oil for minimum quantity lubrication system according to the invention can achieve an excellent balance between misting property and inhibition of floating mist and ensure that an adequate amount reaches the working section, when cutting and grinding is carried out with minimum quantity lubrication system.

EXPLANATION OF SYMBOLS

Figure 1:
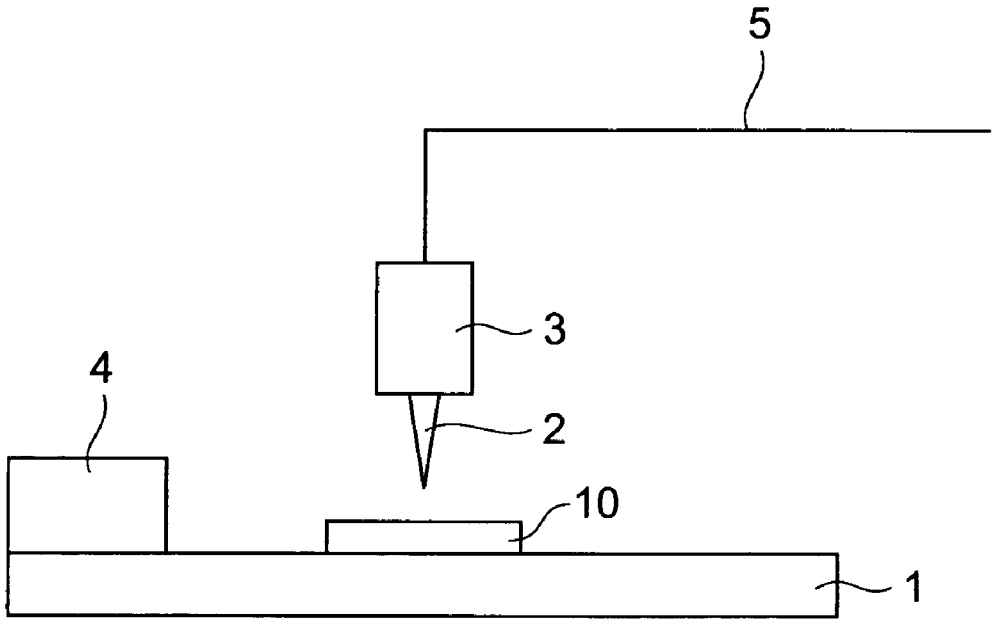
FIG. 1 is a side view of the essential parts of the test apparatus used in the examples.

1: Table, 2: drill, 3: shank, 4: mist collector, 5: oil feed line, 10: workpiece.

BEST MODE FOR CARRYING OUT THE INVENTION

Preferred modes of the invention will now be described in detail.

The oil composition of the invention is an oil composition to be used for cutting and grinding with minimum quantity lubrication system, and it comprises (A) an ester oil with a kinematic viscosity of 0.5-20 $mm^2/s$ at 100° C. (hereinafter also referred to as "component (A)"), and (B) an ester-based polymer with a kinematic viscosity of 20 $mm^2/s$ at 100° C. and an average molecular weight of 5,000-10,000,000 (hereinafter also referred to as "component (B)").

The term "cutting and grinding with minimum quantity lubrication system" used here refers to cutting and grinding which is carried out while supplying oil, in a trace amount of about 1/100,000-1/1,000,000 compared to the amount of oil used for ordinary cutting and grinding, to a cutting and grinding area, together with a compressed fluid (compressed air or the like). More specifically, minimum quantity lubrication system is a system wherein oil is supplied at 0.001-1 ml/min toward the cutting and grinding area together with a compressed fluid (for example, compressed air). A compressed fluid such as nitrogen, argon, helium, carbon dioxide or water may also be used alone in addition to compressed air, or such fluids may be used in combination.

The pressure of the compressed fluid for the cutting and grinding with minimum quantity lubrication system is adjusted to a pressure that does not cause fly-off of the oil and contamination of the ambient area, but a pressure that allows the oil and gas, or a fluid mixture thereof with a liquid, to sufficiently reach the cutting and grinding point. From the standpoint of the cooling property, the temperature of the compressed fluid will usually be room temperature (about 25° C.), or will be adjusted to between room temperature and −50° C.

Component (A) used for the invention is not particularly restricted so long as it is an ester oil with a kinematic viscosity of 0.5-20 $mm^2/s$ at 100° C., and the ester may be either a natural substance (usually one found in a natural fat or oil from an animal or plant) or synthetic. According to the invention, synthetic esters are preferred from the standpoint of stability of the resulting oil composition and uniformity of the ester component.

The alcohol in the ester oil used as component (A) may be a monohydric alcohol or polyhydric alcohol, and the acid in the ester oil may be a monobasic acid or polybasic acid.

As monohydric alcohols there may be used those with 1-24, preferably 1-12, and more preferably 1-8 carbon atoms, and such alcohols may be either straight-chain or branched, and either saturated or unsaturated. As specific examples of C1-24 alcohols there may be mentioned methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched eicosanol, straight-chain or branched heneicosanol, straight-chain or branched tricosanol, straight-chain or branched tetracosanol, and mixtures of these.

As polyhydric alcohols there may be used for most purposes 2-10 hydric alcohols, and preferably 2-6 hydric alcohols. As specific examples of 2-10 hydric polyhydric alcohols there may be mentioned polyhydric alcohols including ethylene glycol, diethylene glycol and polyethylene glycol (3-15mers of ethylene glycol), propylene glycol, dipropylene glycol and polypropylene glycol (3-15mers of propylene glycol), dihydric alcohols such as 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol and neopentyl glycol; glycerin, polyglycerin (2-8mers of glycerin, for example, diglycerin, triglycerin, tetraglycerin, etc.), trimethylolalkanes (trimethylolethane, trimethylolpropane, trimethylolbutane, etc.) and their 2-8mers, pentaerythritols and their 2-4-mers, 1,2,4-butanetriol, 1,3,5-pentanetriol, 1,2,6-hexanetriol, 1,2,3,4-butanetetrol, sorbitol, sorbitan, sorbitol-glycerin condensate, adonitol, arabitol, xylitol, mannitol and the like; and sugars such as xylose, arabinose, ribose, rhamnose, glucose, fructose, galactose, mannose, sorbose, cellobiose, maltose, isomaltose, trehalose, sucrose and the like, as well as their mixtures.

Preferred among these polyhydric alcohols are 2-6 hydric polyhydric alcohols such as ethylene glycol, diethylene glycol, polyethylene glycol (3-10mers of ethylene glycol), propylene glycol, dipropylene glycol, polypropylene glycol (3-10mers of propylene glycol), 1,3-propanediol, 2-methyl-1,2-propanediol, 2-methyl-1,3-propanediol, neopentyl glycol, glycerin, diglycerin, triglycerin, trimethylolalkanes (trimethylolethane, trimethylolpropane, trimethylolbutane, etc.) and their 2-4-mers, pentaerythritol, dipentaerythritol, 1,2,4-butanetriol, 1,3,5-pentanetriol, 1,2,6-hexanetriol, 1,2,3,4-butanetetrol, sorbitol, sorbitan, sorbitol-glycerin condensate, adonitol, arabitol, xylitol, mannitol and the like, as well as mixtures thereof. More preferred are ethylene glycol, propylene glycol, neopentyl glycol, glycerin, trimethylolethane, trimethylolpropane, pentaerythritol, sorbitan and mixtures thereof. Most preferred among these are neopentyl glycol, trimethylolethane, trimethylolpropane, pentaerythritol and mixtures thereof, since these can provide higher oxidation stability.

The alcohol of the ester oil used as component (A) may be a monohydric alcohol or polyhydric alcohol as mentioned above, but a polyhydric alcohol is preferred from the viewpoint of obtaining more excellent lubricity for cutting and grinding, improving the finished surface precision of the workpiece and achieving a more notable anti-wear effect at the tool blade edge, promoting a low pour point and further improving the manageability during the winter season or in cold climates.

In most cases a C2-24 fatty acid will be used as a monobasic acid, among acids for the ester oil used as component (A), and such fatty acids may be straight-chain or branched and either saturated or unsaturated. As specific examples there may be mentioned saturated fatty acids such as acetic acid, propionic acid, straight-chain or branched butanoic acid, straight-chain or branched pentanoic acid, straight-chain or branched hexanoic acid, straight-chain or branched heptanoic acid, straight-chain or branched octanoic acid, straight-chain or branched nonanoic acid, straight-chain or branched decanoic acid, straight-chain or branched undecanoic acid, straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched heptadecanoic acid, straight-chain or branched octadecanoic acid, straight-chain or branched hydroxyoctadecanoic acid, straight-chain or branched nonadecanoic acid, straight-chain or branched eicosanoic acid, straight-chain or branched heneicosanoic acid, straight-chain or branched docosanoic acid, straight-chain or branched tricosanoic acid and straight-chain or branched tetracosanoic acid; and unsaturated fatty acids such as acrylic acid, straight-chain or branched butenoic acid, straight-chain or branched pentenoic acid, straight-chain or branched hexenoic acid, straight-chain or branched heptenoic acid, straight-chain or branched octenoic acid, straight-chain or branched nonenoic acid, straight-chain or branched decenoic acid, straight-chain or branched undecenoic acid, straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched heptadecenoic acid, straight-chain or branched octadecenoic acid, straight-chain or branched hydroxyoctadecenoic acid, straight-chain or branched nonadecenoic acid, straight-chain or branched eicosenoic acid, straight-chain or branched heneicosenoic acid, straight-chain or branched docosenoic acid, straight-chain or branched tricosenoic acid and straight-chain or branched tetracosenoic acid, as well as mixtures thereof. Among these, from the viewpoint of obtaining more excellent lubricity for cutting and grinding, improving precision of the finishing surface of the workpiece and achieving an even greater anti-wear effect for the tool blade edge, particularly C3-20 saturated fatty acids, C3-22 unsaturated fatty acids and mixtures thereof are preferred, C4-18 saturated fatty acids, C4-18 unsaturated fatty acids and their mixtures are more preferred and C4-18 unsaturated fatty acids are even more preferred, while from the viewpoint of preventing sticking, C4-18 saturated fatty acids are especially preferred.

As polybasic acids there may be mentioned C2-16 dibasic acids, trimellitic acid and the like. Such C2-16 dibasic acids may be straight-chain or branched, and either saturated or unsaturated. As specific examples there may be mentioned ethanedioic acid, propanedioic acid, straight-chain or branched butanedioic acid, straight-chain or branched pentanedioic acid, straight-chain or branched hexanedioic acid, straight-chain or branched heptanedioic acid, straight-chain or branched octanedioic acid, straight-chain or branched nonanedioic acid, straight-chain or branched decanedioic acid, straight-chain or branched undecanedioic acid, straight-chain or branched dodecanedioic acid, straight-chain or branched tridecanedioic acid, straight-chain or branched tetradecanedioic acid, straight-chain or branched heptadecanedioic acid, straight-chain or branched hexadecanedioic acid, straight-chain or branched hexenedioic acid, straight-chain or branched heptenedioic acid, straight-chain or branched octenedioic acid, straight-chain or branched nonenedioic acid, straight-chain or branched decenedioic acid, straight-chain or branched undecenedioic acid, straight-chain or branched dodecenedioic acid, straight-chain or branched tridecenedioic acid, straight-chain or branched tetradecenedioic acid, straight-chain or branched heptadecenedioic acid, straight-chain or branched hexadecenedioic acid, and mixtures thereof.

The acid of the ester oil used as component (A) may be a monobasic acid or polybasic acid as mentioned above, but it is preferred to use a monobasic acid to more easily obtain an ester contributing to an improved viscosity index and enhanced misting and anti-sticking properties.

The combination of the alcohol and acid in the ester oil used as component (A) may be any from among the following, for example, so long as the kinematic viscosity of the ester oil is 0.5-20 $mm^2/s$ at 100° C.

(i) Esters of monohydric alcohols and monobasic acids
(ii) Esters of polyhydric alcohols and monobasic acids
(iii) Esters of monohydric alcohols and polybasic acids
(iv) Esters of polyhydric alcohols and polybasic acids
(v) Mixed esters of monohydric alcohol and polyhydric alcohol mixtures and polybasic acids
(vi) Mixed esters of polyhydric alcohols and monobasic acid and polybasic acid mixtures (vii) Mixed esters of monohydric alcohol and polyhydric alcohol mixtures and monobasic acid and polybasic acid mixtures Preferred among these are (ii) esters of polyhydric alcohols and monobasic acids, from the standpoint of obtaining more excellent lubricity during cutting and grinding, improving the finished surface precision of the workpiece and achieving a more notable anti-wear effect at the tool blade edge, promoting a low pour point, further improving the manageability during the winter season or in cold climates, more easily achieving a high viscosity index and further improving the misting property.

As naturally-derived esters to be used as component (A) there may be mentioned natural fats and oils including vegetable oils such as palm oil, palm kernel oil, rapeseed oil, soybean oil, sunflower oil, and high-oleic rapeseed oil or high-oleic sunflower oil with increased oleic acid content among the glyceride fatty acids achieved by cross-breeding or gene recombination, as well as animal oils such as lard.

According to the invention, the ester oil obtained using a polyhydric alcohol as the alcohol component may be a complete ester obtained by esterification of all of the hydroxyl groups in the polyhydric alcohol, or a partial ester wherein some of the hydroxyl groups remain as hydroxyl groups without esterification. Likewise, an organic acid ester obtained using a polybasic acid as the acid component may be a complete ester obtained by esterification of all of the carboxyl groups in the polybasic acid, or it may be a partial ester wherein some of the carboxyl groups remain as carboxyl groups without esterification. From the standpoint of low-temperature manageability and misting property, component (A) is preferably a complete ester.

As mentioned above, the kinematic viscosity of component (A) at 100° C. is no greater than 20 $mm^2/s$, preferably no greater than 17 $mm^2/s$, more preferably no greater than 15 $mm^2/s$ and even more preferably no greater than 12 $mm^2/s$. If the kinematic viscosity of component (A) at 100° C. exceeds 20 $mm^2/s$, the misting property will be inadequate and it will be difficult to ensure that a sufficient amount of mist reaches the working section. Also as mentioned above, the kinematic viscosity of component (A) at 100° C. is preferably at least 0.5 $mm^2/s$, more preferably at least 0.7 $mm^2/s$ and even more preferably at least 0.9 $mm^2/s$. If the kinematic viscosity of the ester oil at 100° C. is less than 0.5 $mm^2/s$, it will not be possible to prevent generation of floating mist even by using component (B), and the lubricity at the working section will be inadequate.

The molecular weight of component (A) is not particularly restricted so long as the kinematic viscosity at 100° C. is 0.5-20 $mm^2/s$, but it is preferably less than 5,000, more preferably no greater than 3,000 and even more preferably no greater than 2,000. If the molecular weight of component (A) exceeds this upper limit, the misting property will tend to be reduced. The molecular weight of component (A) is also preferably at least 100, more preferably at least 150 and even more preferably at least 200. If the molecular weight of component (A) is below this lower limit, it will tend to be difficult to prevent generation of floating mist even by using component (B). When component (A) contains two or more ester oils with different molecular weights, the "molecular weight of component (A)" is the average molecular weight of the ester oils.

There are no particular restrictions on the pour point and viscosity index of component (A), but the pour point is preferably no higher than −10° C. and more preferably no higher than −20° C. The viscosity index is preferably between 100 and 200.

The iodine value of component (A) is preferably 0-80, more preferably 0-60, even more preferably 0-40, yet more preferably 0-20 and most preferably 0-10. The bromine value of the ester of the invention is preferably 0-50 $gBr_2/100$ g, more preferably 0-30 $gBr_2/100$ g, even more preferably 0-20 $gBr_2/100$ g and most preferably 0-10 $gBr_2/100$ g. If the iodine value and bromine value of component (A) are within the respective ranges specified above, the resulting oil composition will tend to have further increased resistance to stickiness. The iodine value referred to here is the value measured by the indicator titration method described in "Test methods for acid value, saponification value, ester value, iodine value, hydroxyl value and unsaponifiable matter of chemical products" of JIS K 0070. The bromine value is the value measured according to "Petroleum distillates and commercial aliphatic olefins—Determination of bromine number—Electric method" of JIS K 2605.

In order to impart more satisfactory lubricating performance to the oil composition of the invention, the hydroxyl value of component (A) is preferably 0.01-300 mgKOH/g and the saponification value is preferably 100-500 mgKOH/g. To provide even higher lubricity, the upper limit for the hydroxyl value of component (A) according to the invention is more preferably 200 mgKOH/g and most preferably 150 mgKOH/g, while the lower limit is more preferably 0.1 mgKOH/g, even more preferably 0.5 mgKOH/g, yet more preferably 1 mgKOH/g, even yet more preferably 3 mgKOH/g and most preferably 5 mgKOH/g. The upper limit for the saponification value of component (A) is more preferably 400 mgKOH/g, and the lower limit is more preferably 200 mgKOH/g. The hydroxyl value referred to here is the value measured by the indicator titration method described in "Test methods for acid value, saponification value, ester value, iodine value, hydroxyl value and unsaponifiable matter of chemical products" of JIS K 0070. The saponification value is the value measured by the indicator titration method described in "Testing method of lubricating oil for aircraft" of JIS K 2503.

Component (B) according to the invention is an ester-based polymer with a kinematic viscosity of greater than 20 $mm^2/s$ at 100° C. and an average molecular weight of 5,000-10,000,000. The term "ester-based polymer" according to the invention includes both (B-1) polymers having an ester bond in the main chain, and (B-2) polymers having an ester bond in a side chain.

The (B-1) polymers having an ester bond in the main chain are "polyesters", i.e. polymers containing a polybasic acid and polyhydric alcohol as essential monomer components. Such polymers may be straight-chain polyesters composed of dibasic acids and dihydric alcohols, or they may be complex esters composed of dibasic or greater polybasic acids and dihydric or greater polyhydric alcohols, and containing a tribasic or greater polybasic acid and/or a trihydric or greater polyhydric alcohol as an essential monomer component. Either a straight-chain polyester or complex polyester may further include a monobasic acid and/or a monohydric alcohol. The polybasic acid and polyhydric alcohol as essential monomer components and the monobasic acid and monohydric alcohol as optional monomer components may be any of the polybasic acids, polyhydric alcohols, monobasic acids and monohydric alcohols mentioned in explaining the component (A) above, and appropriate selection of the types and proportions of these constituent monomers can yield an ester-based polymer as component (B).

The (B-2) polymers having an ester bond in a side chain may be obtained, for example, using a polymerizable monomer with an ethylenic unsaturated bond and an ester bond. As such polymerizable monomers there are preferably used monomers represented by the following general formula (B-2-1), (B-2-2) or (B-2-3).

[Chemical Formula 1]

(B-2-1)

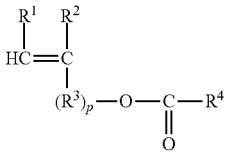

[wherein $R^1$ and $R^2$ may be the same or different and each represents hydrogen or C1-4 alkyl, $R^3$ represents C1-18 alkylene, $R^4$ represents a C1-24 hydrocarbon group and p represents 0 or 1.]

[Chemical Formula 2]

(B-2-2)

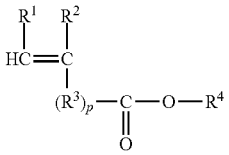

[wherein $R^1$ and $R^2$ may be the same or different and each represents hydrogen or C1-4 alkyl, $R^3$ represents C1-18 alkylene, $R^4$ represents a C1-24 hydrocarbon group and p represents 0 or 1.]

[Chemical Formula 3]

(B-2-3)

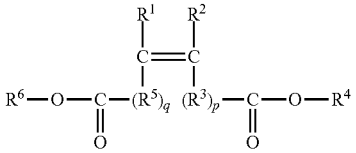

[wherein $R^1$ and $R^2$ may be the same or different and each represents hydrogen or C1-4 alkyl, $R^3$ and $R^5$ may be the same or different and each represents C1-18 alkylene, $R^4$ and $R^6$ may be the same or different and each represents a C1-24 hydrocarbon group, and p and q may be the same or different and each represents 0 or 1.]

$R^1$ and $R^2$ in general formulas (B-2-1)-(B-2-3) above represent hydrogen or C1-4 alkyl. As C1-4 alkyl groups represented by $R^1$ and $R^2$ there may be mentioned methyl, ethyl, straight-chain or branched propyl and straight-chain or branched butyl. Preferred as $R^1$ and $R^2$ are hydrogen, methyl or ethyl, with hydrogen or methyl being more preferred. For the compounds represented by general formulas (B-2-1) and (B-2-3), both $R^1$ and $R^2$ are most preferably hydrogen. For the monomer represented by general formula (B-2-2), most preferably $R^1$ is hydrogen and $R^2$ is methyl.

As C1-18 alkylene groups represented by $R^3$ and $R^5$ there may be mentioned specifically, methylene, ethylene, straight-chain or branched propylene, straight-chain or branched butylene, straight-chain or branched pentyl, straight-chain or branched hexylene, straight-chain or branched heptylene, straight-chain or branched octylene, straight-chain or branched nonylene, straight-chain or branched decylene, straight-chain or branched undecylene, straight-chain or branched dodecylene, straight-chain or branched tridecylene, straight-chain or branched tetradecylene, straight-chain or branched pentadecylene, straight-chain or branched hexadecylene, straight-chain or branched heptadecylene and straight-chain or branched octadecylene.

Also, p in general formulas (B-2-1)-(B-2-3) and p and q in general formula (B-2-3) are each 0 or 1. When p and q are 0, the structure has a double bonded carbon atom and an ester group carbon atom directly bonded together.

In the monomers represented by general formulas (B-2-1)-(B-2-3), preferably p and q are 0 or p and q are 1 and $R^3$ and $R^5$ are C1-10 alkylene groups, more preferably p and q are 0 or p and q are 1 and $R^3$ and $R^5$ are C1-4 alkylene groups, even more preferably p and q are 0 or p and q are 1 and $R^3$ and $R^5$ are methylene or ethylene, even yet more preferably p and q are 0 or p and q are 1 and $R^3$ and $R^5$ are methylene, and most preferably p and q are 0.

As specific examples of C1-24 hydrocarbon groups represented by $R^4$ and $R^6$ there may be mentioned alkyl, cycloalkyl, alkenyl, alkylcycloalkyl, aryl, alkylaryl and arylalkyl.

As examples of alkyl groups there may be mentioned alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl (where the alkyl groups may be straight-chain or branched).

As examples of cycloalkyl groups there may be mentioned C5-7 cycloalkyl groups such as cyclopentyl, cyclohexyl and cycloheptyl. As examples of the aforementioned alkylcycloalkyl groups there may be mentioned C6-11 alkylcycloalkyl groups such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl (with any positions of substitution of the alkyl groups on the cycloalkyl groups).

As examples of the aforementioned alkenyl groups there may be mentioned alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl and octadecenyl (where the alkenyl groups may be straight-chain or branched, and the double bonds may be at any positions).

As examples of the aforementioned aryl groups there may be mentioned aryl groups such as phenyl and naphthyl. As examples of the aforementioned alkylaryl groups there may be mentioned C7-18 alkylaryl groups such as tolyl, xylyl, ethylphenyl, propylphenyl, butylphenyl, pentylphenyl, hexylphenyl, heptylphenyl, octylphenyl, nonylphenyl, decylphenyl, undecylphenyl and dodecylphenyl (where the alkyl groups may be straight-chain or branched and substituted at any positions on the aryl groups).

As examples of the aforementioned arylalkyl groups there may be mentioned C7-12 arylalkyl groups such as benzyl, phenylethyl, phenylpropyl, phenylbutyl, phenylpentyl and phenylhexyl (where the alkyl groups may be straight-chain or branched).

The hydrocarbon groups represented by $R^4$ and $R^6$ are preferably C1-22 hydrocarbon groups, more preferably C1-20 hydrocarbon groups and even more preferably C1-18 hydrocarbon groups.

The monomer represented by general formula (B-2-1) above is preferably an ester of a monobasic fatty acid and a vinyl alcohol, wherein $R^4$ is a C1-22 (preferably C1-20, and more preferably C1-18) hydrocarbon group.

The monomer represented by general formula (B-2-2) above is preferably an acrylic acid ester wherein $R^4$ is a C1-22 (preferably C1-20, and more preferably C1-18) hydrocarbon group or a methacrylic acid ester wherein $R^4$ is a C1-22 (preferably C1-20, and more preferably C1-18) hydrocarbon group, and more preferably it is a methacrylic acid ester wherein $R^4$ is a C1-22 (preferably C1-20, and more preferably C1-18) hydrocarbon group.

The monomer represented by general formula (B-2-3) is preferably a maleic acid diester or fumaric acid diester wherein $R^4$ and $R^6$ are both C1-22 (preferably C1-20, and more preferably C1-18) hydrocarbon groups, and more preferably it is dimethyl maleate, diethyl maleate, dipropyl maleate, dibutyl maleate or the like.

Of the monomers represented by general formulas (B-2-1)-(B-2-3) above, monomers represented by general formula (B-2-2) are preferred from the standpoint of stability and floating mist inhibition.

Component (B) may be a homopolymer consisting of a single type of monomer represented by general formulas (B-2-1)-(B-2-3) above, or it may be a copolymer consisting of two or more thereof. In addition to the monomers represented by general formulas (B-2-1)-(B-2-3) above, there may be further included monomers represented by the following general formulas (B-2-4)-(B-2-7).

[Chemical Formula 4]

(B-2-4)

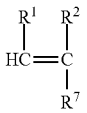

[wherein $R^1$ and $R^2$ may be the same or different and each represents hydrogen or C1-4 alkyl, and $R^7$ represents hydrogen or a C1-24 hydrocarbon group.]

[Chemical Formula 5]

(B-2-5)

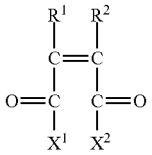

[wherein $R^1$ and $R^2$ may be the same or different and each represents hydrogen or C1-4 alkyl, and $X^1$ and $X^2$ may be the same or different and each represents hydrogen or C1-18 monoalkylamino.]

[Chemical Formula 6]

(B-2-6)

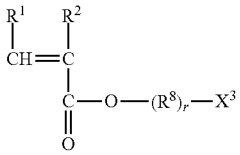

[wherein $R^1$ and $R^2$ may be the same or different and each represents hydrogen or C1-4 alkyl, $R^8$ represents C2-18 alkylene, r represents 0 or 1 and $X^3$ represents a C1-30 organic group containing a nitrogen atom.]

[Chemical Formula 7]

(B-2-7)

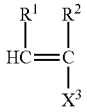

[wherein $R^1$ and $R^2$ may be the same or different and each represents hydrogen or C1-4 alkyl, and $X^3$ represents a C1-30 organic group containing a nitrogen atom.]

$R^1$ and $R^2$ in general formulas (B-2-4)-(B-2-7) each represent hydrogen or C1-4 alkyl. When $R^1$ and $R^2$ are C1-4 alkyl groups, the alkyl groups may be any of the C1-4 alkyl groups mentioned in explaining $R^1$ and $R^2$ for (B-2-1)-(B-2-3) above.

Also, $R^7$ in general formula (B-2-4) is hydrogen or a C1-24 hydrocarbon group. When $R^7$ is a C1-24 hydrocarbon group, the hydrocarbon group may be any of the C1-24 hydrocarbon groups mentioned in explaining $R^4$ and $R^6$ above. $R^7$ is preferably hydrogen or a C1-20 hydrocarbon group, more preferably hydrogen or a C1-15 hydrocarbon group, even more preferably hydrogen or a C1-10 hydrocarbon group and most preferably hydrogen or a C1-6 hydrocarbon group.

Also, $X^1$ and $X^2$ in general formula (B-2-5) each represent hydrogen or C1-18 monoalkylamino. The C1-18 monoalkylamino groups represented by $X^1$ and $X^2$ are residues resulting from removal of hydrogen from the amino group of a C1-18 monoalkylamine group (—$NHR^8$; where $R^8$ is C1-18 alkyl). As C1-18 alkyl groups represented by $R^8$ there may be mentioned alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl (where the alkyl groups may be straight-chain or branched).

As C2-18 alkylene groups represented by $R^8$ in general formula (B-2-6) there may be mentioned, specifically, alkylene groups such as ethylene, propylene, butylene, pentylene, hexylene, heptylene, octylene, nonylene, decylene, undecylene, dodecylene, tridecylene, tetradecylene, pentadecylene, hexadecylene, heptadecylene and octadecylene (where the alkylene groups may be straight-chain or branched).

Also in (B-2-6), r represents 0 or 1. When r is 0, the structure contains O (an oxygen atom) directly bonded to $X^3$.

$X^3$ in general formulas (B-2-6) and (B-2-7) is a C1-30 organic group containing a nitrogen atom. The number of nitrogen atoms in the organic group represented by $X^3$ is not particularly restricted but is preferably one. As mentioned above, the number of carbon atoms in the organic group represented by $X^3$ is 1-30, preferably 1-20, and more preferably 1-16.

The organic group represented by $X^3$ is preferably a group containing an oxygen atom, and it also preferably contains a ring. Particularly from the viewpoint of stability and machining performance, the organic group represented by $X^3$ preferably has an oxygen-containing ring. When the organic group represented by $X^3$ is a group containing a ring, the ring may be an aliphatic ring or aromatic ring, but it is preferably an aliphatic ring. The ring of the organic group represented by $X^3$ is preferably a 6-membered ring from the standpoint of stability and machining performance.

As organic groups represented by $X^3$ there may be mentioned, specifically, dimethylamino, diethylamino, dipropylamino, dibutylamino, anilino, toluidino, xylidino, acetylamino, benzoylamino, morpholino, pyrolyl, pyrrolino, pyridyl, methylpyridyl, pyrrolidinyl, piperidinyl, quinonyl, pyrrolidonyl, pyrrolidono, imidazolino and pyrazino, among which morpholino is particularly preferred.

As preferred examples of monomers represented by general formula (B-2-4) there may be mentioned ethylene, propylene, 1-butene, 2-butene, isobutene and styrene.

As preferred examples of monomers represented by general formula (B-2-5) there may be mentioned maleic acid, fumaric acid, maleic acid amide, fumaric acid amide and mixtures thereof.

As preferred examples of monomers represented by general formula (B-2-6) or (B-2-7) there may be mentioned dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone and mixtures thereof.

Preferred among the monomers represented by general formulas (B-2-4)-(B-2-7) from the standpoint of stability and machining performance are monomers represented by general formulas (B-2-4), (B-2-6) and (B-2-7). Monomers represented by general formulas (B-2-6) and (B-2-7) are more preferred, especially for combination with monomers represented by general formula (B-2-2). Monomers represented by general formulas (B-2-4) are more preferred for combination with monomers represented by general formula (B-2-3).

When component (B) of the invention is a copolymer comprising a monomer represented by general formulas (B-2-1)-(B-2-3) above or two or more monomers represented by general formulas (B-2-4)-(B-2-7) above, there are no particular restrictions on the polymerization form and it may be a block copolymer or random copolymer, although random copolymers are preferred from the standpoint of stability and machining performance.

As preferred examples of (B-2) polymers having an ester bond in a side chain there may be mentioned, specifically, polymethacrylates, polyacrylates, polyvinyl esters, isobutylene-fumaric acid diester copolymers, styrene-fumaric acid diester copolymers and vinyl acetate-fumaric acid diester copolymers.

An ester-based polymer as component (B) is one having a kinematic viscosity of greater than 20 $mm^2/s$ at 100° C. Ester-based polymers with a kinematic viscosity of up to 20 $mm^2/s$ at 100° C. are within the definition of component (A) according to the invention, and if such an ester-based polymer is used instead of component (B), it will not be possible to achieve both a misting property and inhibition of floating mist.

The average molecular weight of component (B) must be at least 5,000 as mentioned above, and it is preferably at least 7,000 and more preferably at least 10,000. If the average molecular weight of the ester-based polymer is less than 5,000, inhibition of floating mist will be insufficient. The average molecular weight of component (B) must also be no greater than 10,000,000 as mentioned above, and it is preferably no greater than 1,000,000, more preferably no greater than 500,000, even more preferably no greater than 300,000 and most preferably no greater than 150,000. If the average molecular weight of the ester-based polymer is greater than 10,000,000 the misting property will be insufficient.

There are no particular restrictions on the content of component (B), but it is preferably at least 0.001% by mass, more preferably at least 0.005% by mass and even more preferably at least 0.01% by mass based on the total weight of the composition. If the content of component (B) is less than 0.001% by mass, the inhibiting effect against floating mist by using component (B) may not be adequately exhibited. The content of component (B) is also preferably no greater than 20% by mass, more preferably no greater than 10% by mass and even more preferably no greater than 8% by mass based on the total weight of the composition. If the content of component (B) exceeds 20% by mass, the misting property and biodegradability will tend to be reduced.

The oil composition of the invention may consist entirely of components (A) and (B) described above, but if necessary it may further contain the following base oils and additives.

As base oils in addition to components (A) and (B) there may be mentioned mineral-based oils such as paraffin-based mineral oils and naphthene-based mineral oils; polyolefins such as propylene oligomers, polybutene, polyisobutylene, C5-20 α-olefin oligomers and co-oligomers of ethylene and C5-20 α-olefins, or their hydrogenated forms; alkylbenzenes such as monoalkylbenzenes, dialkylbenzenes and polyalkylbenzenes; alkylnaphthalenes such as monoalkylnaphthalenes, dialkylnaphthalenes and polyalkylnaphthalenes; polyglycols such as polyethylene glycol, polypropylene glycol, polyoxyethylenepolyoxypropyleneglycol, polyethylene glycolmonoether, polypropyleneglycolmonoether, polyoxyethylenepolyoxypropyleneglycolmonoether, polyethyleneglycol diether, polypropyleneglycol diether and polyoxyethylenepolyoxypropyleneglycol diether; phenyl ethers such as monoalkyldiphenyl ethers, dialkyldiphenyl ethers, monoalkyltriphenyl ethers, dialkyltriphenyl ethers, tetraphenyl ethers, monoalkyltetraphenyl ethers, dialkyltetraphenyl ethers and pentaphenyl ethers, silicone oils; fluoroethers such as perfluoroether, and the like.

The content of such base oils is not particularly restricted so long as they do not impair the performance of the oil composition of the invention, but it is preferably no greater than 90% by mass, more preferably no greater than 80% by mass, even more preferably no greater than 70% by mass, yet more preferably no greater than 50% by mass and even yet more preferably no greater than 30% by mass, although most preferably no base oils are added in addition to components (A) and (B).

The oil composition of the invention preferably contains (C) an oil agent (preferably an oil agent with a molecular weight of less than 5,000) from the viewpoint of further increasing the machining efficiency and tool life.

As (C) oil agents there may be mentioned alcohol oil agents, carboxylic acid oil agents, unsaturated carboxylic acid sulfides, compounds represented by the following general formula (C-1), compounds represented by the following general formula (C-2), polyoxyalkylene compounds, ester oil agents, polyhydric alcohol hydrocarbyl ethers, amine oil agents and the like.

[Chemical Formula 8]

(C-1)

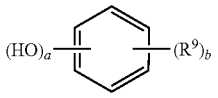

[wherein $R^9$ represents a C1-30 hydrocarbon group, a represents an integer of 1-6 and b represents an integer of 0-5.]

[Chemical Formula 9]

(C-2)

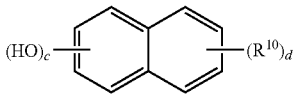

[wherein $R^{10}$ represents a C1-30 hydrocarbon group, C represents an integer of 1-6 and D represents an integer of 0-5.]

An alcohol oil agent may be a monohydric alcohol or a polyhydric alcohol. From the standpoint of achieving even better machining efficiency and tool life, C1-40 monohydric alcohols are preferred, C1-25 alcohols are more preferred and C8-18 alcohols are most preferred. Specifically, there may be mentioned the examples of cited as alcohols for the base oil ester. These alcohols may be straight-chain or branched and either saturated or unsaturated, but from the standpoint of preventing sticking, they are preferably saturated.

A carboxylic acid oil agent may be a monobasic acid or a polybasic acid. From the standpoint of achieving even higher machining efficiency and tool life, C1-40 monobasic carboxylic acids are preferred, C5-25 carboxylic acids are more preferred and C5-20 carboxylic acids are most preferred. Specifically, there may be mentioned the examples of carboxylic acids cited for the base oil ester. These carboxylic acids may be straight-chain or branched and either saturated or unsaturated, but from the standpoint of preventing sticking, saturated carboxylic acids are preferred.

As examples of unsaturated carboxylic acid sulfides there may be mentioned sulfides of unsaturated carboxylic acid oil agents among those cited above. More specifically, there may be mentioned sulfides of oleic acid.

As examples of C1-30 hydrocarbon groups represented by $R^9$ in compounds represented by general formula (C-1) above, there may be mentioned C1-30 straight-chain or branched alkyl, C5-7 cycloalkyl, C6-30 alkylcycloalkyl, C2-30 straight-chain or branched alkenyl, C6-10 aryl, C7-30 alkylaryl and C7-30 arylalkyl. Among these, C1-30 straight-chain or branched alkyl groups are preferred, C1-20 straight-chain or branched alkyl groups are more preferred, C1-10 straight-chain or branched alkyl groups are even more preferred, and C1-4 straight-chain or branched alkyl groups are most preferred. As examples of C1-4 straight-chain or branched alkyl groups there may be mentioned methyl, ethyl, straight-chain or branched propyl and straight-chain or branched butyl.

A hydroxyl group may be substituted at any position, but in the case of two or more hydroxyl groups they are preferably substituted at adjacent carbon atoms. The symbol a is preferably an integer of 1-3 and more preferably 2. The symbol b is preferably an integer of 0-3 and more preferably 1 or 2. As an example of a compound represented by general formula (1) there may be mentioned p-tert-butylcatechol.

As examples of C1-30 hydrocarbon groups represented by $R^{10}$ in compounds represented by general formula (C-2) above, there may be mentioned the same ones as cited for the C1-30 hydrocarbon group represented by $R^9$ in general formula (C-1), and the preferred ones are also the same. A hydroxyl group may be substituted at any position, but in the case of two or more hydroxyl groups they are preferably substituted at adjacent carbon atoms. The symbol c is preferably an integer of 1-3 and more preferably 2. The symbol d is preferably an integer of 0-3 and more preferably 1 or 2. As examples of compounds represented by general formula (2) there may be mentioned 2,2-dihydroxynaphthalene and 2,3-dihydroxynaphthalene.

As examples of polyoxyalkylene compounds there may be mentioned compounds represented by the following general formula (C-3) or (C-4).

$$R^{11}O—(R^{12}O)_e—R^{13} \quad \text{(C-3)}$$

[wherein $R^{11}$ and $R^{13}$ may be the same or different and each represents hydrogen or a C1-30 hydrocarbon group, $R^{12}$ represents C2-4 alkylene and e represents an integer such that the number-average molecular weight is 100-3500.]

$$A\text{-}[(R^{14}O)_f—R^{15}]_g \quad \text{(C-4)}$$

[wherein A represents the residue of a polyhydric alcohol having 3-10 hydroxyl groups of which all or a portion of the hydrogens of the hydroxyl groups have been removed, $R^{14}$ represents C2-4 alkylene, $R^{15}$ represents hydrogen or a C1-30 hydrocarbon group, f represents an integer such that the number-average molecular weight is 100-3500, and g represents the same number as the number of hydrogens removed from the hydroxyl groups of A.]

In general formula (C-3), preferably either or both $R^{11}$ and $R^{13}$ are hydrogen. As examples of C1-30 hydrocarbon groups represented by $R^{11}$ and $R^{13}$ there may be mentioned the examples of C1-30 hydrocarbon groups represented by $R^9$ in general formula (C-1), and their preferred examples are also the same. As specific examples of C2-4 alkylene groups represented by $R^{12}$ there may be mentioned ethylene, propylene (methylethylene) and butylene (ethylethylene). The symbol e is preferably a integer such that the number-average molecular weight is 300-2000, and more preferably an integer such that the number-average molecular weight is 500-1500.

As specific examples of polyhydric alcohols having 3-10 hydroxyl groups for A in general formula (C-4) above, there may be mentioned polyhydric alcohols such as glycerin, polyglycerin (2-4mers of glycerin including diglycerin, triglycerin and tetraglycerin), trimethylolalkanes (trimethylolethane, trimethylolpropane, trimethylolbutane) and their 2-4mers, pentaerythritol, dipentaerythritol, 1,2,4-butanetriol, 1,3,5-pentanetriol, 1,2,6-hexanetriol, 1,2,3,4-butanetetrol, sorbitol, sorbitan, sorbitol-glycerin condensate, adonitol, arabitol, xylitol, mannitol, iditol, tallitol, dulcitol, allitol and the like; and sugars such as xylose, arabinose, ribose, rhamnose, glucose, fructose, galactose, mannose, sorbose, cellobiose, maltose, isomaltose, trehalose and sucrose. Preferred among these are glycerin, polyglycerin, trimethylolalkanes and their 2-4mers, pentaerythritol, dipentaerythritol, sorbitol and sorbitan.

As examples of C2-4 alkylene groups represented by $R^{14}$ there may be mentioned the same examples of C2-4 alkylene groups represented by $R^{12}$ in general formula (C-3). As examples of C1-30 hydrocarbon groups represented by $R^{15}$ there may be mentioned the same examples of C1-30 hydrocarbon groups represented by $R^9$ in general formula (C-1), and their preferred examples are also the same. At least one of the g $R^{15}$ groups is preferably hydrogen, and more preferably all of them are hydrogen. The symbol f is preferably an integer such that the number-average molecular weight is 300-2000, and more preferably an integer such that the number-average molecular weight is 500-1500.

The alcohol in an ester oil agent may be a monohydric alcohol or polyhydric alcohol, and the carboxylic acid may be a monobasic acid or polybasic acid.

Examples of monohydric alcohols and polyhydric alcohols in the ester oil include any monohydric alcohols and polyhydric alcohols, while the acid of the ester oil agent may be a monobasic acid or polybasic acid.

As monohydric alcohols there may be used those with 1-24, preferably 1-12, and more preferably 1-8 carbon atoms, and such alcohols may be either straight-chain or branched, and either saturated or unsaturated. As specific examples of C1-24 alcohols there may be mentioned methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched eicosanol, straight-chain or branched heneicosanol, straight-chain or branched tricosanol, straight-chain or branched tetracosanol, and mixtures of these.

As polyhydric alcohols there may usually be used 2-10 hydric alcohols, and preferably 2-6 hydric alcohols. As specific examples of 2-10 hydric polyhydric alcohols there may be mentioned ethylene glycol, diethylene glycol, polyethylene glycol (3-15mers of ethylene glycol), propylene glycol, dipropylene glycol, polypropylene glycol (3-15mers of propylene glycol), dihydric alcohols such as 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol, neopentyl glycol and the like; other polyhydric alcohols such as glycerin, polyglycerin (2-8mers of glycerin including diglycerin, triglycerin and tetraglycerin), trimethylolalkanes (trimethylolethane, trimethylolpropane and trimethylolbutane) and their 2-8mers, pentaerythritols and their 2-4mers, 1,2,4-butanetriol, 1,3,5-pentanetriol, 1,2,6-hexanetriol, 1,2,3,4-butanetetrol, sorbitol, sorbitan, sorbitol-glycerin condensate, adonitol, arabitol, xylitol, mannitol and the like; and sugars such as xylose, arabinose, ribose, rhamnose, glucose, fructose, galactose, mannose, sorbose, cellobiose, maltose, isomaltose, trehalose and sucrose, and mixtures thereof.

Preferred among these polyhydric alcohols are 2-6 hydric polyhydric alcohols such as ethylene glycol, diethylene glycol, polyethylene glycol (3-10mers of ethylene glycol), propyleneglycol, dipropyleneglycol, polypropyleneglycol (3-10mers of propyleneglycol), 1,3-propanediol, 2-methyl-1,2-propanediol, 2-methyl-1,3-propanediol, neopentyl glycol, glycerin, diglycerin, triglycerin, trimethylolalkanes (trimethylolethane, trimethylolpropane, trimethylolbutane, and the like) and their 2-4mers, pentaerythritol, dipentaerythritol, 1,2,4-butanetriol, 1,3,5-pentanetriol, 1,2,6-hexanetriol, 1,2,3,4-butanetetrol, sorbitol, sorbitan, sorbitol-glycerin condensate, adonitol, arabitol, xylitol, mannitol and the like, as well as mixtures thereof. More preferred are ethylene glycol, propylene glycol, neopentyl glycol, glycerin, trimethylolethane, trimethylolpropane, pentaerythritol, sorbitan and mixtures thereof. Most preferred among these are neopentyl glycol, trimethylolethane, trimethylolpropane, pentaerythritol and mixtures thereof, since these can yield higher heat and oxidation stability.

The alcohol of the ester oil agent may be a monohydric alcohol or polyhydric alcohol as mentioned above, but it is preferably a polyhydric alcohol from the standpoint of achieving machining efficiency and tool life, and of more easily lowering the pour point and further improving manageability in winter season and cold climates. Using a polyhydric alcohol ester will increase the effect of improving the finished surface precision of the workpiece and preventing wear of the tool blade edge during cutting and grinding.

In most cases a C2-24 fatty acid will be used as the monobasic acid among acids for the ester oil agent, and such fatty acids may be straight-chain or branched and either saturated or unsaturated. As specific examples there may be mentioned saturated fatty acids such as acetic acid, propionic acid, straight-chain or branched butanoic acid, straight-chain or branched pentanoic acid, straight-chain or branched hexanoic acid, straight-chain or branched heptanoic acid, straight-chain or branched octanoic acid, straight-chain or branched nonanoic acid, straight-chain or branched decanoic acid, straight-chain or branched undecanoic acid, straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched heptadecanoic acid, straight-chain or branched octadecanoic acid, straight-chain or branched hydroxyoctadecanoic acid, straight-chain or branched nonadecanoic acid, straight-chain or branched eicosanoic acid, straight-chain or branched heneicosanoic acid, straight-chain or branched docosanoic acid, straight-chain or branched tricosanoic acid and straight-chain or branched tetracosanoic acid; and unsaturated fatty acids such as acrylic acid, straight-chain or branched butenoic acid, straight-chain or branched pentenoic acid, straight-chain or branched hexenoic acid, straight-chain or branched heptenoic acid, straight-chain or branched octenoic acid, straight-chain or branched nonenoic acid, straight-chain or branched decenoic acid, straight-chain or branched undecenoic acid, straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched heptadecenoic acid, straight-chain or branched octadecenoic acid, straight-chain or branched hydroxyoctadecenoic acid, straight-chain or branched nonadecenoic acid, straight-chain or branched eicosenoic acid, straight-chain or branched heneicosenoic acid, straight-chain or branched docosenoic acid, straight-chain or branched tricosenoic acid and straight-chain or branched tetracosenoic acid, as well as mixtures thereof. From the viewpoint of achieving superior working efficiency and tool life, as well as manageability, C3-20 saturated fatty acids, C3-22 unsaturated fatty acids and their mixtures are preferred, C4-18 saturated fatty acids, C4-18 unsaturated fatty acids and their mixtures are more preferred and C4-18 unsaturated fatty acids are even more preferred, and from the viewpoint of sticking prevention, C4-18 saturated fatty acids are preferred.

As polybasic acids there may be mentioned C2-16 dibasic acids, trimellitic acid and the like. Such C2-16 dibasic acids may be straight-chain or branched, and either saturated or unsaturated. As specific examples there may be mentioned ethanedioic acid, propanedioic acid, straight-chain or branched butanedioic acid, straight-chain or branched pentanedioic acid, straight-chain or branched hexanedioic acid, straight-chain or branched heptanedioic acid, straight-chain or branched octanedioic acid, straight-chain or branched nonanedioic acid, straight-chain or branched decanedioic acid, straight-chain or branched undecanedioic acid, straight-chain or branched dodecanedioic acid, straight-chain or branched tridecanedioic acid, straight-chain or branched tetradecanedioic acid, straight-chain or branched heptadecanedioic acid, straight-chain or branched hexadecanedioic acid, straight-chain or branched hexenedioic acid, straight-chain or branched heptenedioic acid, straight-chain or branched octenedioic acid, straight-chain or branched nonenedioic acid, straight-chain or branched decenedioic acid, straight-chain or branched undecenedioic acid, straight-chain or branched dodecenedioic acid, straight-chain or branched tridecanedioic acid, straight-chain or branched tetradecanedioic acid, straight-chain or branched heptadecenedioic acid, straight-chain or branched hexadecanedioic acid, and mixtures thereof.

The combination of alcohol and acid in the ester oil agent may be as desired without any particular restrictions, but the following esters may be mentioned as preferred examples for ester oil agents to be used for the invention.

(i) Esters of monohydric alcohols and monobasic acids
(ii) Esters of polyhydric alcohols and monobasic acids
(iii) Esters of monohydric alcohols and polybasic acids
(iv) Esters of polyhydric alcohols and polybasic acids
(v) Mixed esters of monohydric alcohol and polyhydric alcohol mixtures and polybasic acids
(vi) Mixed esters of polyhydric alcohols and monobasic acid and polybasic acid mixtures
(vii) Mixed esters of monohydric alcohol and polyhydric alcohol mixtures and monobasic acid and polybasic acid mixtures When a polyhydric alcohol is used as the alcohol component, the ester may be a complete ester obtained by esterification of all of the hydroxyl groups in the polyhydric alcohol, or a partial ester wherein some of the hydroxyl groups remain as hydroxyl groups without esterification. When a polybasic acid is used as the carboxylic acid component, the ester may be a complete ester obtained by esterification of all of the carboxyl groups in the polybasic acid, or a partial ester wherein some of the carboxyl groups remain as carboxyl groups without esterification. From the standpoint of machining performance, the ester oil agent is preferably a partial ester.

There are no particular restrictions on the total number of carbon atoms in the ester oil agent, but from the standpoint of achieving superior machining efficiency and tool life, the ester preferably has a total of at least 7 carbon atoms, more preferably at least 9 carbon atoms and most preferably at least 11 carbon atoms. From the standpoint of avoiding increased staining and corrosion, and of compatibility with organic materials, the ester preferably has a total of no greater than 60 carbon atoms, more preferably no greater than 45 carbon atoms, even more preferably no greater than 26 carbon atoms, yet more preferably no greater than 24 carbon atoms and most preferably no greater than 22 carbon atoms.

The polyhydric alcohol in the polyhydric alcohol hydrocarbyl ether will usually be a 2-10 hydric and preferably 2-6 hydric compound. As specific examples of 2-10 hydric polyhydric alcohols there may be mentioned ethylene glycol, diethylene glycol, polyethylene glycol (3-15mers of ethylene glycol), propylene glycol, dipropylene glycol, polypropylene glycol (3-15mers of propylene glycol), dihydric alcohols such as 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol, neopentyl glycol and the like; polyhydric alcohols such as glycerin, polyglycerin (2-8mers of glycerin including diglycerin, triglycerin and tetraglycerin), trimethylolalkanes (trimethylolethane, trimethylolpropane and trimethylolbutane) and their 2-8mers, pentaerythritols and their 2-4mers, 1,2,4-butanetriol, 1,3,5-pentanetriol, 1,2,6-hexanetriol, 1,2,3,4-butanetetrol, sorbitol, sorbitan, sorbitol-glycerin condensate, adonitol, arabitol, xylitol, mannitol and the like; and sugars such as xylose, arabinose, ribose, rhamnose, glucose, fructose, galactose, mannose, sorbose, cellobiose, maltose, isomaltose, trehalose and sucrose, and mixtures thereof.

Preferred among these polyhydric alcohols are 2-6 hydric polyhydric alcohols such as ethylene glycol, diethylene glycol, polyethylene glycol (3-10mers of ethylene glycol), propyleneglycol, dipropyleneglycol, polypropyleneglycol (3-10mers of propyleneglycol), 1,3-propanediol, 2-methyl-1,2-propanediol, 2-methyl-1,3-propanediol, neopentyl glycol, glycerin, diglycerin, triglycerin, trimethylolalkanes (trimethylolethane, trimethylolpropane, trimethylolbutane, and the like) and their 2-4mers, pentaerythritol, dipentaerythritol, 1,2,4-butanetriol, 1,3,5-pentanetriol, 1,2,6-hexanetriol, 1,2,3,4-butanetetrol, sorbitol, sorbitan, sorbitol-glycerin condensate, adonitol, arabitol, xylitol, mannitol and the like, as well as mixtures thereof. More preferred are ethylene glycol, propylene glycol, neopentyl glycol, glycerin, trimethylolethane, trimethylolpropane, pentaerythritol, sorbitan and mixtures thereof. Among these, glycerin is most preferred from the standpoint of achieving superior machining efficiency and tool life.

The polyhydric alcohol hydrocarbyl ether used may be one having all or only a portion of the hydroxyl groups of the polyhydric alcohol converted by hydrocarbyl etherification. From the standpoint of achieving superior machining efficiency and tool life, preferably only a portion of the hydroxyl groups of the polyhydric alcohol are converted by hydrocarbyl etherification (partial etherified product). The hydrocarbyl group referred to here is a C1-24 hydrocarbon group such as C1-24 alkyl, C2-24 alkenyl, C5-7 cycloalkyl, C6-11 alkylcycloalkyl, C6-10 aryl, C7-18 alkylaryl or C7-18 arylalkyl.

As C1-24 alkyl groups there may be mentioned methyl, ethyl, n-propyl, isopropyl, n-butyl, isobutyl, sec-butyl, tert-butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, straight-chain or branched octadecyl, straight-chain or branched nonadecyl, straight-chain or branched eicosyl, straight-chain or branched heneicosyl, straight-chain or branched docosyl, straight-chain or branched tricosyl and straight-chain or branched tetracosyl.

As C2-24 alkenyl groups there may be mentioned vinyl, straight-chain or branched propenyl, straight-chain or branched butenyl, straight-chain or branched pentenyl, straight-chain or branched hexenyl, straight-chain or branched heptenyl, straight-chain or branched octenyl, straight-chain or branched nonenyl, straight-chain or branched decenyl, straight-chain or branched undecenyl, straight-chain or branched dodecenyl, straight-chain or branched tridecenyl, straight-chain or branched tetradecenyl, straight-chain or branched pentadecenyl, straight-chain or branched hexadecenyl, straight-chain or branched heptadecenyl, straight-chain or branched octadecenyl, straight-chain or branched nonadecenyl, straight-chain or branched eicosenyl, straight-chain or branched heneicosenyl, straight-chain or branched docosenyl, straight-chain or branched tricosenyl and straight-chain or branched tetracosenyl.

As C5-7 cycloalkyl groups there may be mentioned cyclopentyl, cyclohexyl and cycloheptyl. As C6-11 alkylcycloalkyl groups there may be mentioned methylcyclopentyl, dimethylcyclopentyl (including all structural isomers), methylethylcyclopentyl (including all structural isomers), diethylcyclopentyl (including all structural isomers), methylcyclohexyl, dimethylcyclohexyl (including all structural isomers), methylethylcyclohexyl (including all structural isomers), diethylcyclohexyl (including all structural isomers), methylcycloheptyl, dimethylcycloheptyl (including all structural isomers), methylethylcycloheptyl (including all structural isomers) and diethylcycloheptyl (including all structural isomers).

As C6-10 aryl groups there may be mentioned phenyl and naphthyl. As C7-18 alkylaryl groups there may be mentioned tolyl (including all structural isomers), xylyl (including all structural isomers), ethylphenyl (including all structural isomers), straight-chain or branched propylphenyl (including all structural isomers), straight-chain or branched butylphenyl (including all structural isomers), straight-chain or branched pentylphenyl (including all structural isomers), straight-chain or branched hexylphenyl (including all structural isomers), straight-chain or branched heptylphenyl (including all structural isomers), straight-chain or branched octylphenyl (including all structural isomers), straight-chain or branched nonylphenyl (including all structural isomers), straight-chain or branched decylphenyl (including all structural isomers), straight-chain or branched undecylphenyl (including all structural isomers) and straight-chain or branched dodecylphenyl (including all structural isomers).

As C7-12 arylalkyl groups there may be mentioned benzyl, phenylethyl, phenylpropyl (including propyl isomers), phenylbutyl (including butyl isomers), phenylpentyl (including pentyl isomers) and phenylhexyl (including hexyl isomers).

Preferred among these from the standpoint of achieving superior machining efficiency and tool life are C2-18 straight-chain or branched alkyl groups and C2-18 straight-chain or branched alkenyl groups, among which C3-12 straight-chain or branched alkyl and oleyl (residue obtained by removing hydroxyl from oleyl alcohol) are more preferred.

A monoamine is preferred for use as an amine oil agent. The number of carbon atoms of the monoamine is preferably 6-24 and more preferably 12-24. Here, the number of carbon atoms is the total number of carbon atoms of the monoamine, and when the monoamine has two or more hydrocarbon groups it is the total number of their carbon atoms.

Monoamines to be used for the invention include primary monoamines, secondary monoamines and tertiary monoamines, although primary monoamines are preferred from the standpoint of increasing working efficiency and extending tool life.

As hydrocarbon groups bonded to the nitrogen atom of the monoamine there may be used alkyl, alkenyl, cycloalkyl, alkylcycloalkyl, aryl, alkylaryl, arylalkyl and the like, although alkyl and alkenyl groups are preferred from the standpoint of achieving superior machining efficiency and tool life. The alkyl and alkenyl groups may be straight-chain or branched, but are preferably straight-chain from the standpoint of achieving superior machining efficiency and tool life.

As specific examples of preferred monoamines to be used for the invention there may be mentioned hexylamine (including all isomers), heptylamine (including all isomers), octylamine (including all isomers), nonylamine (including all isomers), decylamine (including all isomers), undecylamine (including all isomers), dodecylamine (including all isomers), tridecylamine (including all isomers), tetradecylamine (including all isomers), pentadecylamine (including all isomers), hexadecylamine (including all isomers), heptadecylamine (including all isomers), octadecylamine (including all isomers), nonadecylamine (including all isomers), eicosylamine (including all isomers), heneicosylamine (including all isomers), docosylamine (including all isomers), tricosylamine (including all isomers), tetracosylamine (including all isomers), octadecenylamine (including all isomers) (including oleylamine and the like), and mixtures of two or more thereof. Among these, C12-24 primary monoamines are preferred, C14-20 primary monoamines are more preferred and C16-18 primary monoamines are even more preferred, from the standpoint of achieving superior machining efficiency and tool life.

According to the invention, only one selected from among the aforementioned oil agents may be used, or a mixture of two or more thereof may be used. Preferred among these, from the standpoint of achieving superior machining efficiency and tool life, are one or a mixture of two or more selected from carboxylic acid oil agents and amine oil agents.

The content of the (C) oil agent is not particularly restricted, but from the standpoint of achieving superior machining efficiency and tool life, it is preferably at least 0.01% by mass, more preferably at least 0.05% by mass and even more preferably at least 0.1% by mass based on the total weight of the composition. From the standpoint of stability, the oil agent content is preferably no greater than 15% by mass, more preferably no greater than 10% by mass and even more preferably no greater than 5% by mass based on the total weight of the composition.

The oil composition of the invention preferably also further contains (D) an extreme-pressure agent, from the viewpoint of achieving superior machining efficiency and tool life. Particularly when the (D) extreme-pressure agent is used together with the (C) oil agent described above, the components work synergistically to allow even greater superiority to be achieved in machining efficiency and tool life. As described hereunder, the oil composition of the invention may be used as a lubricating oil for sections other than machine tool working sections, in which case they preferably contain the (C) oil agent.

As preferred extreme pressure agents there may be mentioned the sulfur compounds and phosphorus compounds mentioned below.

There are no particular restrictions on sulfur compounds to be used so long as the properties of the oil composition of the invention are not impaired, but preferred for use are dihydrocarbyl polysulfide, sulfidized esters, sulfide mineral oils, zinc dithiophosphate compounds, zinc dithiocarbaminate compounds, molybdenum dithiophosphate compounds and molybdenum dithiocarbaminate.

Dihydrocarbyl polysulfides are sulfur-based compounds commonly known as polysulfides or olefin sulfides, and specifically they are represented by the following general formula (D-1).

$$R^{16}—S_h—R^{17} \quad \text{(D-1)}$$

[wherein $R^{16}$ and $R^{17}$ may be the same or different and each represents C3-20 straight chain or branched alkyl, C6-20 aryl, C6-20 alkylaryl or C6-20 arylalkyl, and h represents an integer of 2-6 and preferably 2-5.]

As specific examples of $R^{16}$ and $R^{17}$ in general formula (D-1) there may be mentioned straight chain or branched alkyl groups such as n-propyl, isopropyl, n-butyl, isobutyl, sec-butyl, tert-butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, straight-chain or branched octadecyl, straight-chain or branched nonadecyl and straight-chain or branched eicosyl; aryl groups such as phenyl and naphthyl; alkylaryl groups such as tolyl (including all structural isomers), ethylphenyl (including all structural isomers), straight-chain or branched propylphenyl (including all structural isomers), straight-chain or branched butylphenyl (including all structural isomers), straight-chain or branched pentylphenyl (including all structural isomers), straight-chain or branched hexylphenyl (including all structural isomers), straight-chain or branched heptylphenyl (including all structural isomers), straight-chain or branched octylphenyl (including all structural isomers), straight-chain or branched nonylphenyl (including all structural isomers), straight-chain or branched decylphenyl (including all structural isomers), straight-chain or branched undecylphenyl (including all structural isomers), straight-chain or branched dodecylphenyl (including all structural isomers), xylyl (including all structural isomers), ethylmethylphenyl (including all structural isomers), diethylphenyl (including all structural isomers), di(straight-chain or branched)propylphenyl (including all structural isomers), di(straight-chain or branched)butylphenyl (including all structural isomers), methylnaphthyl (including all structural isomers), ethylnaphthyl (including all structural isomers), straight-chain or branched propylnaphthyl (including all structural isomers), straight-chain or branched butylnaphthyl (including all structural isomers), dimethylnaphthyl (including all structural isomers), ethylmethylnaphthyl (including all structural isomers), diethylnaphthyl (including all structural isomers), di(straight-chain or branched)propylnaphthyl (including all structural isomers) and di(straight-chain or branched)butylnaphthyl (including all structural isomers); and arylalkyl groups such as benzyl, phenylethyl (including all isomers) and phenylpropyl (including all isomers). Among these there are preferred compounds wherein $R^{16}$ and $R^{17}$ in general formula (D-1) are C3-18 alkyl groups derived from propylene, 1-butene or isobutylene, or C6-8 aryl, alkylaryl or arylalkyl groups, and as examples of such groups there may be mentioned alkyl groups such as isopropyl, branched hexyl derived from propylene dimer (including all branched isomers), branched nonyl derived from propylene trimer (including all branched isomers), branched dodecyl derived from propylene tetramer (including all branched isomers), branched pentadecyl derived from propylene pentamer (including all branched isomers), branched octadecyl derived from propylene hexamer (including all branched isomers), sec-butyl, tert-butyl, branched octyl derived from 1-butene dimer (including all branched isomers), branched octyl derived from isobutylene dimer (including all branched isomers), branched dodecyl derived from 1-butene trimer (including all branched isomers), branched dodecyl derived from isobutylene trimer (including all branched isomers), branched hexadecyl derived from 1-butene tetramer (including all branched isomers) and branched hexadecyl derived from isobutylene tetramer (including all branched isomers); alkylaryl groups such as phenyl, tolyl (including all structural isomers), ethylphenyl (including all structural isomers) and xylyl (including all structural isomers); and arylalkyl groups such as benzyl and phenylethyl (including all isomers).

From the standpoint of achieving superior machining efficiency and tool life, $R^{16}$ and $R^{17}$ in general formula (D-1) above are more preferably each separately a C3-18 branched alkyl group derived from ethylene or propylene and most preferably a C6-15 branched alkyl group derived from ethylene or propylene.

As specific examples of sulfidized esters there may be mentioned those prepared by sulfidizing of vegetable oils and fats such as beef tallow, lard, fish oil, rapeseed oil and soybean oil; unsaturated fatty acid esters obtained by reacting unsaturated fatty acids (including oleic acid, linoleic acid and fatty acids extracted from the aforementioned animal and vegetable oils and fats) and various alcohols; as well as mixtures thereof, by any desired methods.

A sulfide mineral oil is a mineral oil in which simple sulfur is dissolved. The mineral oil used for the sulfide mineral oil of the invention is not particularly restricted, and specifically there may be mentioned paraffin-based mineral oils, naphthene-based mineral oils and the like obtained by refining lube-oil distillates, in turn obtained by atmospheric distillation and vacuum distillation of stock oil, by an appropriate combination of refining treatments such as solvent deasphalting, solvent extraction, hydrotreatment, solvent dewaxing, catalytic dewaxing, hydrorefining, sulfuric acid cleaning, white clay treatment or the like. The simple sulfur may be in the form of a mass, powder, molten liquid or the like, but simple sulfur in powder or molten liquid form is preferred for use because it allows efficient dissolution in base oils. Simple sulfur in molten liquid form is miscible with other liquids and therefore has the advantage of allowing the solution operation to be accomplished in a very brief period, but the handling temperature must be above the melting point of simple sulfur, requiring special apparatuses such as heating equipment, and because it must be handled in a high temperature atmosphere the handling is often associated with danger. Simple sulfur in powder form, however, is inexpensive and easy to handle and has a sufficiently short dissolution time, and is therefore particularly preferred. There are no particular restrictions on the sulfur content of a sulfide mineral oil for the invention, but in most cases it is preferably 0.05-1.0% by mass and more preferably 0.1-0.5% by mass based on the total weight of the sulfide mineral oil.

The zinc dithiophosphate compounds, zinc dithiocarbaminate compounds, molybdenum dithiophosphate compounds and molybdenum dithiocarbaminate compounds referred to here are compounds represented by the following general formulas (D-2)-(D-5).

[Chemical Formula 10]

(D-2)

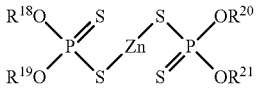

[Chemical Formula 11]

(D-3)

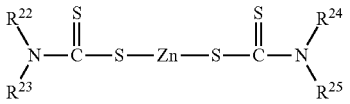

[Chemical Formula 12]

-continued (D-4)

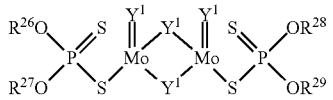

[Chemical Formula 13]

(D-5)

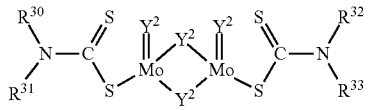

[wherein $R^{18}$, $R^{19}$, $R^{20}$, $R^{21}$, $R^{22}$, $R^{23}$, $R^{24}$, $R^{25}$, $R^{26}$, $R^{27}$, $R^{28}$, $R^{29}$, $R^{30}$, $R^{31}$, $R^{32}$ and $R^{33}$ may be the same or different and each represents a C1 or greater hydrocarbon group, and $Y^1$ and $Y^2$ each represent an oxygen or sulfur atom.]

As specific examples of hydrocarbon groups represented by $R^{18}$-$R^{33}$ there may be mentioned alkyl groups such as methyl, ethyl, propyl (including all branched isomers), butyl (including all branched isomers), pentyl (including all branched isomers), hexyl (including all branched isomers), heptyl (including all branched isomers), octyl (including all branched isomers), nonyl (including all branched isomers), decyl (including all branched isomers), undecyl (including all branched isomers), dodecyl (including all branched isomers), tridecyl (including all branched isomers), tetradecyl (including all branched isomers), pentadecyl (including all branched isomers), hexadecyl (including all branched isomers), heptadecyl (including all branched isomers), octadecyl (including all branched isomers), nonadecyl (including all branched isomers), eicosyl (including all branched isomers), heneicosyl (including all branched isomers), docosyl (including all branched isomers), tricosyl (including all branched isomers) and tetracosyl (including all branched isomers); cycloalkyl groups such as cyclopentyl, cyclohexyl and cycloheptyl; alkylcycloalkyl groups such as methylcyclopentyl (including all substituted isomers), ethylcyclopentyl (including all substituted isomers), dimethylcyclopentyl (including all substituted isomers), propylcyclopentyl (including all branched isomers and substituted isomers), methylethylcyclopentyl (including all substituted isomers), trimethylcyclopentyl (including all substituted isomers), butylcyclopentyl (including all branched isomers and substituted isomers), methylpropylcyclopentyl (including all branched isomers and substituted isomers), diethylcyclopentyl (including all substituted isomers), dimethylethylcyclopentyl (including all substituted isomers), methylcyclohexyl (including all substituted isomers), ethylcyclohexyl (including all substituted isomers), dimethylcyclohexyl (including all substituted isomers), propylcyclohexyl (including all branched isomers and substituted isomers), methylethylcyclohexyl (including all substituted isomers), trimethylcyclohexyl (including all substituted isomers), butylcyclohexyl (including all branched isomers and substituted isomers), methylpropylcyclohexyl (including all branched isomers and substituted isomers), diethylcyclohexyl (including all substituted isomers), dimethylethylcyclohexyl (including all substituted isomers), methylcycloheptyl (including all substituted isomers), ethylcycloheptyl (including all substituted isomers), dimethylcycloheptyl (including all substituted isomers), propylcycloheptyl (including all branched isomers and substituted isomers), methylethylcycloheptyl (including all substituted isomers), trimethylcycloheptyl (including all substituted isomers), butylcycloheptyl (including all branched isomers and substituted isomers), methylpropylcycloheptyl (including all branched isomers and substituted isomers), diethylcycloheptyl (including all substituted isomers) and dimethylethylcycloheptyl (including all substituted isomers); aryl groups such as phenyl and naphthyl; alkylaryl groups such as tolyl (including all substituted isomers), xylyl (including all substituted isomers), ethylphenyl (including all substituted isomers), propylphenyl (including all branched isomers and substituted isomers), methylethylphenyl (including all substituted isomers), trimethylphenyl (including all substituted isomers), butylphenyl (including all branched isomers and substituted isomers), methylpropylphenyl (including all branched isomers and substituted isomers), diethylphenyl (including all substituted isomers), dimethylethylphenyl (including all substituted isomers), pentylphenyl (including all branched isomers and substituted isomers), hexylphenyl (including all branched isomers and substituted isomers), heptylphenyl (including all branched isomers and substituted isomers), octylphenyl (including all branched isomers and substituted isomers), nonylphenyl (including all branched isomers and substituted isomers), decylphenyl (including all branched isomers and substituted isomers), undecylphenyl (including all branched isomers and substituted isomers), dodecylphenyl (including all branched isomers and substituted isomers), tridecylphenyl (including all branched isomers and substituted isomers), tetradecylphenyl (including all branched isomers and substituted isomers), pentadecylphenyl (including all branched isomers and substituted isomers), hexadecylphenyl (including all branched isomers and substituted isomers), heptadecylphenyl (including all branched isomers and substituted isomers) and octadecylphenyl (including all branched isomers and substituted isomers); and arylalkyl groups such as benzyl, phenethyl, phenylpropyl (including all branched isomers) and phenylbutyl (including all branched isomers).

According to the invention, using at least one compound selected from the group consisting of dihydrocarbyl polysulfides and sulfidized esters among the aforementioned sulfur compounds is preferred since it will allow an even higher level of machining efficiency and tool life to be achieved.

As specific examples of phosphorus compounds there may be mentioned phosphoric acid esters, acidic phosphoric acid esters, acidic phosphoric acid ester amine salts, chlorinated phosphoric acid esters, phosphorous acid esters and phosphorothionates, as well as metal salts of phosphorus compounds represented by the following general formula (D-6) or (D-7). These phosphorus compounds may also be esters of phosphoric acid, phosphorous acid or thiophosphoric acid with alkanols or polyether alcohols, or derivatives thereof.

[Chemical Formula 14]

(D-6)

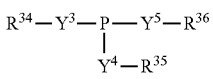

[wherein $Y^3$, $Y^4$ and $Y^5$ may be the same or different and each represents an oxygen or sulfur atom, with the proviso that at least two of $Y^3$, $Y^4$ and $Y^5$ are oxygen atoms, while $R^{34}$, $R^{35}$ and $R^{36}$ may be the same or different and each represents hydrogen or a C1-30 hydrocarbon group.]

[Chemical Formula 15]

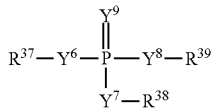

(D-7)

[wherein $Y^6$, $Y^7$, $Y^8$ and $Y^9$ may be the same or different and each represents an oxygen atom or sulfur atom, with the proviso that at least three among $Y^6$, $Y^7$, $Y^8$ and $Y^9$ are oxygen atoms, while $R^{37}$, $R^{38}$ and $R^{39}$ may be the same or different and each represents hydrogen or a C1-30 hydrocarbon group.]

More specifically, as phosphoric acid esters there may be mentioned tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate, xylenyldiphenyl phosphate and the like;

as acidic phosphoric acid esters there may be mentioned monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate, dioleyl acid phosphate and the like;

as acidic phosphoric acid ester amine salts there may be mentioned salts of amines such as methylamines, ethylamines, propylamines, butylamines, pentylamines, hexylamines, heptylamines, octylamines, dimethylamines, diethylamines, dipropylamines, dibutylamines, dipentylamines, dihexylamines, diheptylamines, dioctylamines, trimethylamines, triethylamines, tripropylamines, tributylamines, tripentylamines, trihexylamines, triheptylamine and trioctylamines of the aforementioned acidic phosphoric acid esters;

as chlorinated phosphoric acid esters there may be mentioned tris dichloropropyl phosphate, tris chloroethyl phosphate, tris chlorophenyl phosphate, polyoxyalkylene-bis[di(chloroalkyl)] phosphate and the like;

as phosphorous acid esters there may be mentioned dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite, tricresyl phosphite and the like; and as phosphorothionates there may be mentioned tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyldiphenyl phosphorothionate, xylenyldiphenyl phosphorothionate, tris(n-propylphenyl) phosphorothionate, tris(isopropylphenyl) phosphorothionate, tris(n-butylphenyl) phosphorothionate, tris(isobutylphenyl) phosphorothionate, tris(s-butylphenyl) phosphorothionate and tris(t-butylphenyl) phosphorothionate.

For metal salts of the phosphorus compounds represented by general formulas (D-6) and (D-7) above, alkyl, cycloalkyl, alkenyl, alkylcycloalkyl, aryl, alkylaryl and arylalkyl groups may be mentioned as specific examples of C1-30 hydrocarbon groups represented by $R^{34}$-$R^{39}$ in the formulas.

As examples of the aforementioned alkyl groups there may be mentioned alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl (where the alkyl groups may be straight-chain or branched).

As the aforementioned cycloalkyl groups there may be mentioned C5-7 cycloalkyl groups such as cyclopentyl, cyclohexyl and cycloheptyl. As examples of the aforementioned alkylcycloalkyl groups there may be mentioned C6-11 alkylcycloalkyl groups such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl (with any positions of substitution of the alkyl groups on the cycloalkyl groups).

As examples of the aforementioned alkenyl groups there may be mentioned alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl and octadecenyl (where the alkenyl groups may be straight-chain or branched, and the double bonds may be at any positions).

As examples of the aforementioned aryl groups there may be mentioned aryl groups such as phenyl and naphthyl. As examples of the aforementioned alkylaryl groups there may be mentioned C7-18 alkylaryl groups such as tolyl, xylyl, ethylphenyl, propylphenyl, butylphenyl, pentylphenyl, hexylphenyl, heptylphenyl, octylphenyl, nonylphenyl, decylphenyl, undecylphenyl and dodecylphenyl (where the alkyl groups may be straight-chain or branched and substituted at any positions on the aryl groups).

As examples of the aforementioned arylalkyl groups there may be mentioned C7-12 arylalkyl groups such as benzyl, phenylethyl, phenylpropyl, phenylbutyl, phenylpentyl and phenylhexyl (where the alkyl groups may be straight-chain or branched).

The C1-30 hydrocarbon groups represented by $R^{34}$-$R^{39}$ are preferably C1-30 alkyl or C6-24 aryl groups, more preferably C3-18 alkyl groups and even more preferably C4-12 alkyl groups.

Here, $R^{34}$, $R^{35}$ and $R^{36}$ may be the same or different and each represents hydrogen or one of the aforementioned hydrocarbon groups, where preferably 1-3 from among $R^{34}$, $R^{35}$ and $R^{36}$ are the aforementioned hydrocarbon groups, more preferably 1-2 are the aforementioned hydrocarbon groups and even more preferably two are the aforementioned hydrocarbon groups.]

Also, $R^{37}$, $R^{38}$ and $R^{39}$ may be the same or different and each represents hydrogen or one of the aforementioned hydrocarbon groups, where preferably 1-3 from among $R^{37}$, $R^{38}$ and $R^{39}$ are the aforementioned hydrocarbon groups, more preferably 1-2 are the aforementioned hydrocarbon groups and even more preferably two are the aforementioned hydrocarbon groups.]

For the phosphorus compound represented by general formula (D-6), at least two among $Y^3$-$Y^5$ must be oxygen atoms, but preferably all of $Y^3$-$Y^5$ are oxygen atoms.

For the phosphorus compound represented by general formula (D-7), at least two among $Y^6$-$Y^9$ must be oxygen atoms, but preferably all of $Y^6$-$Y^9$ are oxygen atoms.

As examples of phosphorus compounds represented by general formula (D-6) there may be mentioned phosphorous acid and monothiophosphorous acid; phosphorous acid monoesters and monothiophosphorous acid monoesters containing one of the aforementioned C1-30 hydrocarbon groups, phosphorous acid diesters and monothiophosphorous acid diesters containing two of the aforementioned C1-30 hydrocarbon groups; phosphorous acid triesters and monothiophosphorous acid triesters containing three of the aforementioned C1-30 hydrocarbon groups; and mixtures thereof. Preferred among these are phosphorous acid monoesters and phosphorous acid diesters, with phosphorous acid diesters being more preferred.

As examples of phosphorus compounds represented by general formula (D-7) there may be mentioned phosphoric acid and monothiophosphoric acid; phosphoric acid monoesters and monothiophosphoric acid monoesters containing one of the aforementioned C1-30 hydrocarbon groups, phosphoric acid diesters and monothiophosphoric acid diesters containing two of the aforementioned C1-30 hydrocarbon groups; phosphoric acid triesters and monothiophosphoric acid triesters containing three of the aforementioned C1-30 hydrocarbon groups; and mixtures thereof. Preferred among these are phosphoric acid monoesters and phosphoric acid diesters, with phosphoric acid diesters being more preferred.

As metal salts of phosphorus compounds represented by general formulas (D-6) and (D-7) there may be mentioned salts obtained by neutralization of all or a portion of the acidic hydrogens of the phosphorus compounds using metal bases. As such metal bases there may be mentioned metal oxides, metal hydroxides, metal carbonates, metal chlorides and the like, where specific examples of metals include alkali metals such as lithium, sodium, potassium and cesium, alkaline earth metals such as calcium, magnesium and barium and heavy metals such as zinc, copper, iron, lead, nickel, silver, manganese and the like. Preferred among these are alkaline earth metals such as calcium and magnesium, and zinc.

These phosphorus compound metal salts will differ in structure depending on the valence of the metal and the number of OH groups or SH groups in the phosphorus compound, and therefore no limitations are placed on the structure; however, when 1 mole of zinc oxide is reacted with 2 moles of a phosphoric acid diester (with one OH group), for example, a compound having the structure represented by formula (D-8) below may be obtained as the major component, although polymerized molecules may also be present.

[Chemical Formula 16]

(D-8)

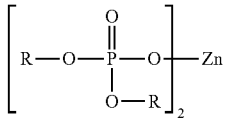

Also, when 1 mole of zinc oxide is reacted with 1 mole of a phosphoric acid monoester (with two OH groups), for example, a compound having the structure represented by (D-9) below may be obtained as the major component, although polymerized molecules may also be present.

[Chemical Formula 17]

(D-9)

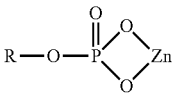

Two or more of these may also be used in admixture.

According to the invention, phosphoric acid esters, acidic phosphoric acid esters and acidic phosphoric acid ester amines are preferred among these phosphorus compounds from the standpoint of achieving superior machining efficiency and tool life.

As described hereunder, the oil composition of the invention may be applied for purposes other than metal working, and when the oil composition of the invention is used as an oil for machine tool sliding surfaces, it preferably comprises an acidic phosphoric acid ester or an acidic phosphoric acid ester amine salt. Also, when the oil composition of the invention is used as a hydraulic oil, a phosphoric acid ester is preferred. When it is used as both a sliding surface oil and a hydraulic oil, it is preferred to use a combination of a phosphoric acid ester with at least one selected from among acidic phosphoric acid esters and acidic phosphoric acid ester amine salts.

The oil composition of the invention may contain either a sulfur compound or phosphorus compound, or it may contain both. From the standpoint of achieving superior machining efficiency and tool life, it preferably contains a phosphorus compound or both a sulfur compound and phosphorus compound, and more preferably it contains both a sulfur compound and phosphorus compound.

The content of the (D) extreme pressure agent may be as desired, but from the standpoint of achieving superior machining efficiency and tool life, it is preferably at least 0.005% by mass, more preferably at least 0.01% by mass and even more preferably at least 0.05% by mass, based on the total weight of the composition. From the viewpoint of preventing abnormal abrasion, the extreme pressure agent content is preferably no greater than 20% by mass, more preferably no greater than 15% by mass and even more preferably no greater than 12% by mass, based on the total weight of the composition.

According to the invention, the aforementioned (C) oil agent or (D) extreme pressure agent may be used alone, but from the viewpoint of achieving superior machining efficiency and tool life, the (C) oil agent and (D) extreme pressure agent are preferably used in combination.

The oil composition of the invention preferably also further contains (E) an organic acid salt, from the viewpoint of achieving superior machining efficiency and tool life. As organic acid salts there are preferably used sulfonates, phenates, salicylates and mixtures thereof. As cationic components for these organic acid salts there may be mentioned alkali metals such as sodium and potassium; alkaline earth metals such as magnesium, calcium and barium; ammonia, amines such as C1-3 alkyl group-containing alkylamines (monomethylamine, dimethylamine, trimethylamine, monoethylamine, diethylamine, triethylamine, monopropylamine, dipropylamine, tripropylamine and the like), C1-3 alkanol group-containing alkanolamines (monoethanolamine, dimethanolamine, trimethanolamine, monoethanolamine, diethanolamine, triethanolamine, monopropanolamine, dipropanolamine, tripropanolamine and the like), and zinc, but alkali metals and alkaline earth metals are preferred among these, and calcium is particularly preferred. Using an alkali metal or alkaline earth metal as the cationic component of the organic acid salt will tend to produce even higher lubricity.

The sulfonate used may be one produced by any desired process. For example, there may be used alkali metal salts, alkaline earth metal salts and amine salts of alkylaromatic sulfonic acids obtained by sulfonation of alkylaromatic compounds with molecular weights of 100-1500 and preferably 200-700, as well as mixtures thereof. As the alkylaromatic sulfonic acids referred to here there may be mentioned synthetic sulfonic acids including sulfonated alkylaromatic compounds of lube-oil distillates of common mineral oils, petroleum sulfonic acids such as "mahogany acid" yielded as a by-product of white oil production, sulfonated products of alkylbenzenes with straight-chain or branched alkyl groups, which are by-products in production plants for alkylbenzenes used as starting materials for detergents or are obtained by alkylation of benzene with polyolefins, and sulfonated alkylnaphthalenes such as dinonylnaphthalene. There may also be mentioned neutral (normal) sulfonates obtained by reacting the aforementioned alkylaromatic sulfonic acids with alkali metal bases (alkali metal oxides, hydroxides and the like), alkaline earth metal bases (alkaline earth metal oxides, hydroxides and the like) or the aforementioned amines (ammonia, alkylamines, alkanolamines, etc.); basic sulfonates obtained by heating neutral (normal) sulfonates with an excess of an alkali metal base, alkaline earth metal base or amine in the presence of water; "carbonated overbased sulfonates" obtained by reacting neutral (normal) sulfonates with alkali metal bases, alkaline earth metal bases or amines in the presence of carbon dioxide gas; "borated overbased sulfonates" produced by reacting neutral (normal) sulfonates with alkali metal bases, alkaline earth metal bases or amines and boric acid compounds such as boric acid and boric anhydride, or by reacting carbonated overbased sulfonates with boric acid compounds such as boric acid and boric anhydride; as well as mixtures of the above-mentioned compounds.

As phenates there may be mentioned, specifically, neutral phenates obtained by reacting alkylphenols having one or two C4-20 alkyl groups with alkali metal bases (alkali metal oxides, hydroxides and the like), alkaline earth metal bases (alkaline earth metal oxides, hydroxides and the like) or the aforementioned amines (ammonia, alkylamines, alkanolamines, etc.) in the presence or in the absence of elemental sulfur; basic phenates obtained by heating neutral phenates with an excess of an alkali metal base, alkaline earth metal base or amine in the presence of water; "carbonated overbased phenates" obtained by reacting neutral phenates with alkali metal bases, alkaline earth metal bases or amines in the presence of carbon dioxide gas; "borated overbased phenates" produced by reacting neutral phenates with alkali metal bases, alkaline earth metal bases or amines and boric acid compounds such as boric acid and boric anhydride, or by reacting carbonated overbased phenates with boric acid compounds such as boric acid and boric anhydride; as well as mixtures of the above-mentioned compounds.

As salicylates there may be mentioned, specifically, neutral salicylates obtained by reacting alkylsalicylic acids having one or two C4-20 alkyl groups with alkali metal bases (alkali metal oxides, hydroxides and the like), alkaline earth metal bases (alkaline earth metal oxides, hydroxides and the like) or the aforementioned amines (ammonia, alkylamines, alkanolamines, etc.) in the presence or in the absence of elemental sulfur; basic salicylates obtained by heating neutral salicylates with an excess of an alkali metal base, alkaline earth metal base or amine in the presence of water; "carbonated overbased salicylates" obtained by reacting neutral salicylates with alkali metal bases, alkaline earth metal bases or amines in the presence of carbon dioxide gas; "borated overbased salicylates" produced by reacting neutral salicylates with alkali metal bases, alkaline earth metal bases or amines and boric acid compounds such as boric acid and boric anhydride, or by reacting carbonated overbased salicylates with boric acid compounds such as boric acid and boric anhydride; as well as mixtures of the above-mentioned compounds.

The base value of the (E) organic acid salt is preferably 50-500 mgKOH/g and more preferably 100-450 mgKOH/g. If the total base value of the organic acid salt is less than 100 mgKOH/g the lubricity-enhancing effect of the organic acid salt addition will tend to be unsatisfactory, while organic acid salts with a total base value of greater than 500 mgKOH/g are also not preferred because they are generally very difficult to produce and obtain. The base value referred to here is the base value [mgKOH/g] measured by a perchloric acid method based on section 7 of "Petroleum product and lubricating oils—Neutralization value test methods" of JIS K 2501.

The content of the (E) organic acid salt is preferably 0.1-30% by mass, more preferably 0.5-25% by mass and even more preferably 1-20% by mass based on the total weight of the composition. If the content of the (E) organic acid salt is below this lower limit, the improving effect of the addition on the machining efficiency and tool life will tend to be unsatisfactory, while if it is above the aforementioned upper limit the stability of the oil composition will be reduced and deposits will tend to form.

According to the invention, the (E) organic acid salt may be used alone or the organic acid salt may be used in combination with other additives. From the standpoint of achieving superior machining efficiency and tool life, it is preferred to use a combination of an organic acid salt with the aforementioned extreme-pressure agent, and it is particularly preferred to use a combination of three components, a sulfur compound, a phosphorus compound and an organic acid salt.

The oil composition of the invention preferably further contains (F) an antioxidant. Addition of an antioxidant can prevent sticking caused by degradation of the constituent components, while further enhancing the heat and oxidation stability.

As (F) antioxidants there may be mentioned phenol-based antioxidants, amine-based antioxidants, zinc dithiophosphate-based antioxidants, and antioxidants used as food additives.

As phenol-based antioxidants there may be used any phenol-based compounds that are employed as antioxidants for lubricating oils, with no particular restrictions, and as preferred examples there may be mentioned one or more alkylphenol compounds selected from among compounds represented by the following general formulas (F-1) and (F-2).

[Chemical Formula 18]

(F-1)

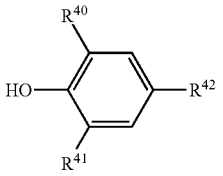

[wherein $R^{40}$ represents a C1-4 alkyl group, $R^{41}$ represents hydrogen or a C1-4 alkyl group, and $R^{42}$ represents hydrogen, a C1-4 alkyl group, or a group represented by the following general formula (i) or (ii):

[Chemical Formula 19]

(i)

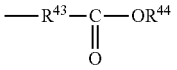

(where $R^{43}$ represents C1-6 alkylene and $R^{44}$ represents a C1-24 alkyl or alkenyl group)

[Chemical Formula 20]

(ii)

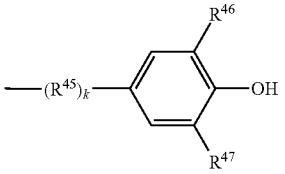

(where $R^{45}$ represents a C1-6 alkylene group, $R^{46}$ represents a C1-4 alkyl group, $R^{47}$ represents hydrogen or a C1-4 alkyl group and k represents 0 or 1).]

[Chemical Formula 21]

(F-2)

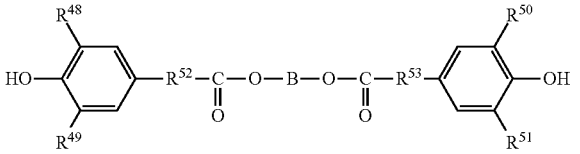

[wherein $R^{48}$ and $R^{50}$ may be the same or different and each represents C1-4 alkyl, $R^{49}$ and $R^{51}$ may be the same or different and each represents hydrogen or C1-4 alkyl, $R^{52}$ and $R^{53}$ may be the same or different and each represents C1-6 alkylene, and B represents C1-18 alkylene or a group represented by the following general formula (iii):

$$—R^{55}—S—R^{56}— \quad \text{(iii)}$$

(where $R^{55}$ and $R^{56}$ may be the same or different and each represents a C1-6 alkylene group).]

As amine-based antioxidants for the invention there may be used any amine-based compounds that are employed as antioxidants for lubricating oils, with no particular restrictions, and as preferred examples there may be mentioned one or more aromatic amines selected from among phenyl-α-naphthylamine or N-p-alkylphenyl-α-naphthylamines represented by the following general formula (F-3), and p,p'-dialkyldiphenylamines represented by the following general formula (F-4).

[Chemical Formula 22]

(F-3)

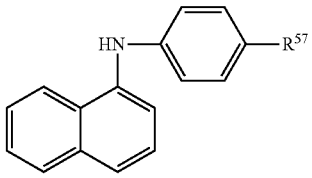

[wherein $R^{57}$ represents hydrogen or an alkyl group.]

[Chemical Formula 23]

(F-4)

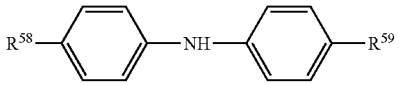

[wherein $R^{58}$ and $R^{59}$ may be the same or different and each represents an alkyl group.]

As specific examples of amine-based antioxidants there may be mentioned 4-butyl-4'-octyldiphenylamine, phenyl-α-naphthylamine, octylphenyl-α-naphthylamine, dodecylphenyl-α-naphthylamine, and mixtures thereof.

As dithiozinc phosphate-based antioxidants there may be mentioned zinc dithiophosphate compounds represented by general formula (D-2) above.

Antioxidants employed as food additives may also be used, although these partially overlap with the aforementioned phenol-based antioxidants, and there may be mentioned as examples 2,6-di-tert-butyl-p-cresol (DBPC), 4,4'-methylenebis(2,6-di-tert-butylphenol), 4,4'-bis(2,6-di-tert-butylphenol), 4,4'-thiobis(6-tert-butyl-o-cresol), ascorbic acid (vitamin C), ascorbic acid fatty acid esters, tocopherol (vitamin E), 3,5-di-tert-butyl-4-hydroxyanisole, 2-tert-butyl-4-hydroxyanisole, 3-tert-butyl-4-hydroxyanisole, 1,2-dihydro-6-ethoxy-2,2,4-trimethylquinoline (ethoxyquin), 2-(1,1-dimethyl)-1,4-benzenediol (TBHQ) and 2,4,5-trihydroxybutyrophenone (THBP).

Preferred among these antioxidants are phenol-based antioxidants, amine-based antioxidants and antioxidants that are employed as food additives. The use of food additive antioxidants is especially preferred when biodegradability is a primary concern, and of these, ascorbic acid (vitamin C), ascorbic acid fatty acid esters, tocopherol (vitamin E), 2,6-di-tert-butyl-p-cresol (DBPC), 3,5-di-tert-butyl-4-hydroxyanisole, 2-tert-butyl-4-hydroxyanisole, 3-tert-butyl-4-hydroxyanisole, 1,2-dihydro-6-ethoxy-2,2,4-trimethylquinoline (ethoxyquin), 2-(1,1-dimethyl)-1,4-benzenediol (TBHQ) and 2,4,5-trihydroxybutyrophenone (THBP) are preferred, among which ascorbic acid (vitamin C), ascorbic acid fatty acid esters, tocopherol (vitamin E), 2,6-di-tert-butyl-p-cresol (DBPC) and 3,5-di-tert-butyl-4-hydroxyanisole are more preferred.

There are no particular restrictions on the (F) antioxidant content, but for maintenance of satisfactory heat and oxidation stability the content is preferably 0.01% by mass or greater, more preferably 0.05% by mass or greater and most preferably 0.1% by mass or greater based on the total weight of the composition. Since no corresponding effect can be expected with larger amounts of addition, the content is preferably no greater than 10% by mass, more preferably no greater than 5% by mass and most preferably no greater than 3% by mass.

The oil composition of the invention may contain various additives known in the prior art in addition to those mentioned above. As examples of such additives there may be mentioned extreme pressure agents (including chlorine-based extreme pressure agents) other than the aforementioned phosphorus compounds and sulfur compounds; moistening agents such as diethyleneglycol monoalkylethers; film-forming agents such as acrylic polymers, paraffin wax, microwax, slack wax and polyolefin wax; water displacement agents such as fatty acid amine salts; solid lubricants such as graphite, fluorinated graphite, molybdenum disulfide, boron nitride and polyethylene powder; corrosion inhibitors such as amines, alkanolamines, amides, carboxylic acids, carboxylic acid salts, sulfonic acid salts, phosphoric acid, phosphoric acid salts and polyhydric alcohol partial esters; metal inactivators such as benzotriazole and thiadiazole; antifoaming agents such as methylsilicone, fluorosilicone and polyacrylate; and non-ash dispersants such as alkenylsuccinic imides, benzylamine and polyalkenylamineaminoamides. The contents of such known additives when used in combination are not particularly restricted, but they are generally added in amounts so that the total content of the known additives is 0.1-10% by mass based on the total weight of the composition.

The oil composition of the invention may also contain chlorine-based additives such as the aforementioned chlorine-based extreme-pressure agents, but they preferably contain no chlorine-based additives from the viewpoint of improving stability and reducing the burden on the environment. The chlorine concentration is preferably no greater than 1000 ppm by mass, more preferably no greater than 500 ppm by mass, even more preferably no greater than 200 ppm by mass and most preferably no greater than 100 ppm by mass, based on the total weight of the composition.

There are no particular restrictions on the kinematic viscosity of the oil composition of the invention, but from the standpoint of facilitating supply to the working section, the kinematic viscosity at 100° C. is preferably no greater than 20 $mm^2/s$, more preferably no greater than 17 $mm^2/s$, even more preferably no greater than 15 $mm^2/s$ and most preferably no greater than 12 $mm^2/s$. On the other hand, the kinematic viscosity of the oil composition of the invention at 100° C. is preferably at least 0.5 $mm^2/s$, more preferably at least 0.7 $mm^2/s$ and most preferably at least 0.9 $mm^2/s$.

From the standpoint of storage stability and rust prevention, the moisture content of the oil composition of the invention is preferably no greater than 20,000 ppm, more preferably no greater than 10,000 ppm and even more preferably no greater than 5000 ppm. From the viewpoint of achieving superior machining efficiency and tool life, the moisture content is preferably at least 200 ppm, more preferably at least 300 ppm, even more preferably at least 400 ppm and yet more preferably at least 500 ppm.

The moisture content according to the invention is the moisture content as measured by Karl Fischer coulemetric titration based on JIS K 2275.

When the moisture content of the oil composition of the invention is adjusted by addition of water, the added water may be hard water or soft water, and the source of water used may be tap water, industrial water, ion-exchanged water, distilled water, alkali ion water or the like.

The oil composition of the invention having the construction described above can achieve both misting and floating mist properties that have been difficult to achieve by the prior art with cutting and grinding in minimum quantity lubrication systems. The oil composition of the invention is therefore highly useful for enhancing machining performance and improving working environments.

EXAMPLES

The present invention will now be explained in greater detail based on examples and comparative examples, with the understanding that these examples are in no way limitative on the invention.

Examples 1-14, Comparative Example 1

For Examples 1-14 and Comparative Example 1, the ester oils and ester-based polymers listed below were used to prepare the oil compositions shown in Tables 1 to 3.

(Ester Oils)

A1: Methyl oleate (kinematic viscosity at 100° C.: 1.8 $mm^2/s$)

A2: Diisodecyl adipate (kinematic viscosity at 100° C.: 3.7 $mm^2/s$)

A3: Triester of trimethylolpropane and n-octanoic acid/n-decanoic acid mixed acid (kinematic viscosity at 100° C.: 4.4 $mm^2/s$)

A4: Diester of neopentyl glycol and oleic acid (kinematic viscosity at 100° C.: 5.8 $mm^2/s$)

A5: High-oleic rapeseed oil (kinematic viscosity at 100° C.: 8.5 $mm^2/s$)

A6: Triester of trimethylolpropane and oleic acid (kinematic viscosity at 100° C.: 9.8 $mm^2/s$)

(Ester-Based Polymers)

B1: Polymethacrylate (polymer comprising monomer mixture represented by general formula (B-2-2) wherein $R^1$ is hydrogen, $R^2$ is methyl, $R^3$ is C1-18 alkyl; kinematic viscosity at 100° C.: 400 $mm^2/s$, average molecular weight: 10,000)

B2: Polymethacrylate (polymer comprising monomer mixture represented by general formula (B-2-2) wherein $R^1$ is hydrogen, $R^2$ is methyl, $R^3$ is C1-18 alkyl; kinematic viscosity at 100° C.: 1200 $mm^2/s$, average molecular weight: 50,000)

B3: Polymethacrylate (polymer comprising monomer mixture represented by general formula (B-2-2) wherein $R^1$ is hydrogen, $R^2$ is methyl, $R^3$ is C1-18 alkyl; kinematic viscosity at 100° C.: 1700 $mm^2/s$, average molecular weight: 150,000)

B4: Polymethacrylate (polymer comprising monomer mixture represented by general formula (B-2-2) wherein $R^1$ is hydrogen, $R^2$ is methyl, $R^3$ is C1-18 alkyl; kinematic viscosity at 100° C.: 2,500 $mm^2/s$, average molecular weight: 500,000)

B5: Complex ester of neopentyl glycol and dimer acid (kinematic viscosity at 100° C.: 2,000 $mm^2/s$, average molecular weight: 100,000)

The oil compositions of Examples 1-14 and Comparative Example 1 were then subjected to the following tests.

[Floating Mist Measurement Test]

Figure 2:
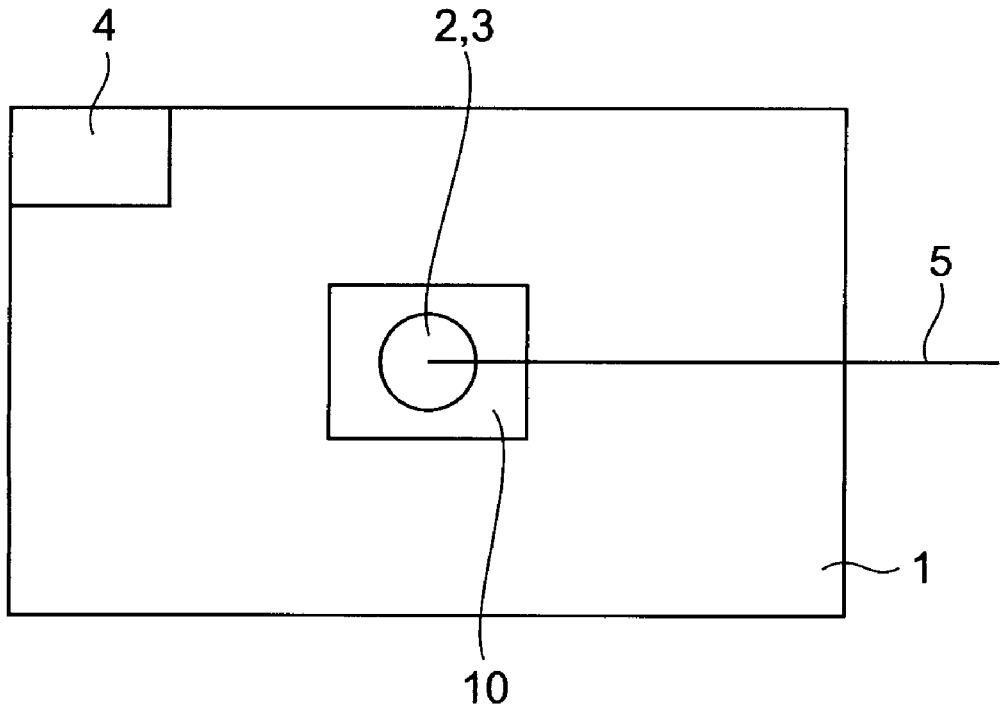
FIG. 2 is a top view of the essential parts of the test apparatus used in the examples.

FIG. 1 and FIG. 2 are, respectively, a side view and top view of the essential parts of a test apparatus used for the floating mist measurement test. The test apparatus shown in FIG. 1 and FIG. 2 has an MQL device (EB-3, product of Fuji BC Engineering Co., Ltd.) and a mist counter installed on a machining center (MB-46V, product of Okuma Machine Tools, Inc.), for cutting and grinding in minimum quantity lubrication system. Specifically, the test apparatus shown in FIG. 1 and FIG. 2 is equipped with a table 1 supporting a workpiece 10, a tool 2 situated opposite the top of the table 1 (NACHI straight drill SGOH3D (5.0 mm×82 mm×28 mm), hereinafter referred to as "drill 2"), a shank 3 supported in a rotatable manner around its rotation axis as the center, and a mist counter 5 (P-5L Portable Dust Monitor, product of Sibata Scientific Technology, Ltd.) situated around the edge of the top of the table 1.

While not shown in detail here, the drill 2 has a helical groove, and two discharge holes (oil holes, ϕ1.0 mm) are provided at prescribed locations on the cutting blade flank of the groove. Inside the drill 2 and shank 3 there are provided channels connecting with the discharge holes of the drill 2, and an oil feed line 5 is connected to the opening at the side of the channel of the shank 3 opposite the drill 2 side. Thus, the oil composition fed from the oil feed line 5 together with compressed air can be converted to a mist from the discharge holes of the drill 2, through the channels formed by the drill 2 and shank 3, toward the workpiece 10.

In the test apparatus having this construction, cutting and grinding was performed with minimum quantity lubrication system at a drill rotation rate of 1,000 rpm, a misting pressure difference of 0.12 MPa (injection pressure: 0.38 MPa, discharge pressure: 0.26 MPa), a discharge pressure from the misting apparatus of 0.26 MPa and blowing toward the workpiece at 180 shots/min. The amount of floating mist produced during one minute, from 3 minutes to 4 minutes after the start of machining, was measured using the mist counter 5. The results are shown in Tables 1 to 3.

[Test for Measurement of Amount of Tapped Oil Reaching Cutting Point]

A glass dish (inner diameter: 95 mm) was placed in the test apparatus shown in FIG. 1 and FIG. 2 instead of the workpiece 10, and the drill 2 and shank 3 were situated so that the distance between the bottom of the dish and the tip of the drill 2 was 50 mm. The misted oil composition was blown in from the discharge hole of the drill 2 toward the dish under the same conditions as for the floating mist measurement test, and the amount of oil composition collected in the dish (amount delivered per unit time) was measured. The results are shown in Tables 1 to 3.

[Lubricity Performance Test (Tapping Test)]

Each oil composition was subjected to a tapping test under the following conditions. Supply of the oil composition to the working section was accomplished by using an MQL apparatus (MCA by TACO) for blowing toward the working section at 2 $cm^2$/min, with a misting pressure difference of 0.20 MPa (injection pressure: 0.42 MPa, discharge pressure: 0.22 MPa) and a discharge pressure of 0.22 MPa from the misting apparatus. The test was carried out 9 times for each oil composition, and the average value for the tapping energy was calculated. The results are shown in Tables 1 to 3.

(Tapping Conditions)

Tool: Nut tap M8 (P=1.25 mm)
Lower hole diameter: ϕ6.8 mm
Workpiece: S25C (t=10 mm)
Cutting speed: 9.0 m/min

TABLE 1

| | | Example 1 | Example 2 | Example 3 | Example 4 | Example 5 | Example 6 |
|---|---|---|---|---|---|---|---|
| Composition [% by mass] | A1 | 99.00 | — | — | — | — | — |
| | A2 | — | 99.00 | — | — | — | — |
| | A3 | — | — | 99.00 | — | — | — |
| | A4 | — | — | — | 99.00 | — | — |
| | A5 | — | — | — | — | 99.00 | — |
| | A6 | — | — | — | — | — | 99.00 |
| | B2 | 1.00 | 1.00 | 1.00 | 1.00 | 1.00 | 1.00 |
| Floating mist [mg/$m^3$] | | 2.01 | 0.95 | 1.09 | 0.89 | 0.81 | 0.77 |
| Amount of tapped oil reaching cutting point [g/h] | | 7.01 | 8.12 | 7.22 | 7.98 | 7.11 | 6.99 |
| Tapping energy (mean) [N · m] | | 368. | 360 | 358 | 350 | 362 | 347 |

TABLE 2

| | | Example 7 | Example 8 | Example 9 | Example 10 | Example 11 |
|---|---|---|---|---|---|---|
| Composition [% by mass] | A4 | 99.99 | 99.90 | 95.00 | 90.00 | 99.00 |
| | B1 | — | — | — | 10.00 | 1.00 |
| | B2 | — | 0.10 | 5.00 | — | — |
| | B3 | — | — | — | — | — |
| | B4 | 0.01 | — | — | — | — |
| | B5 | — | — | — | — | — |
| Floating mist [mg/$m^3$] | | 2.07 | 1.88 | 0.77 | 0.69 | 1.18 |
| Amount of tapped oil reaching cutting point [g/h] | | 7.88 | 8.11 | 6.99 | 6.89 | 7.71 |
| Tapping energy (mean) [N · m] | | 362 | 367 | 360 | 368 | 361 |

TABLE 3

| | | Example 12 | Example 13 | Example 14 | Comp. Ex. 1 |
|---|---|---|---|---|---|
| Composition [% by mass] | A4 | 99.00 | 99.00 | 95.00 | 100.00 |
| | B3 | 1.00 | — | — | — |
| | B4 | — | 1.00 | — | — |
| | B5 | — | — | 1.00 | — |

TABLE 3-continued

| | Example 12 | Example 13 | Example 14 | Comp. Ex. 1 |
|---|---|---|---|---|
| Floating mist [mg/m$^3$] | 0.78 | 0.74 | 1.78 | 19.1 |
| Amount of tapped oil reaching cutting point [g/h] | 8.43 | 7.05 | 7.51 | 5.81 |
| Tapping energy (mean) [N · m] | 355 | 361 | 365 | 379 |

The invention claimed is:

1. An oil composition for cutting and grinding by minimum quantity lubrication system, comprising:

a complete ester oil of a polyhydric alcohol and a monobasic acid with a kinematic viscosity of 1.8-9.8 mm$^2$/s at 100° C., and an ester-based polymer with a kinematic viscosity of 400 mm$^2$/s to 2,500 mm$^2$/s at 100° C. and an average molecular weight of 50,000 to 500,000;

wherein the content of the complete ester oil is 90.0% by mass to 99.99% by mass based on the total amount of the oil composition;

wherein the content of the ester-based polymer is 0.01% by mass to 5% by mass based on the total amount of the oil composition, and wherein the ester-based polymer is a polymethacrylate.

* * * * *